US011633959B2

(12) United States Patent
Nakatani et al.

(10) Patent No.: US 11,633,959 B2
(45) Date of Patent: Apr. 25, 2023

(54) THERMAL PRINT HEAD

(71) Applicant: ROHM CO., LTD., Kyoto (JP)

(72) Inventors: Goro Nakatani, Kyoto (JP); Akira Fujita, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 17/470,957

(22) Filed: Sep. 9, 2021

(65) Prior Publication Data

US 2022/0097409 A1 Mar. 31, 2022

(30) Foreign Application Priority Data

Sep. 29, 2020 (JP) ..... JP2020-163108

(51) Int. Cl.
*B41J 2/335* (2006.01)

(52) U.S. Cl.
CPC ..... *B41J 2/33515* (2013.01); *B41J 2/3355* (2013.01); *B41J 2/33595* (2013.01)

(58) Field of Classification Search
CPC ... B41J 2/33515; B41J 2/3355; B41J 2/33595
See application file for complete search history.

(56) References Cited

U.S. PATENT DOCUMENTS 6,330,014 B1 * 12/2001 Arauchi ..... B41J 2/345 347/208
2018/0354265 A1 * 12/2018 Aoki ..... B41J 2/33535

FOREIGN PATENT DOCUMENTS

JP 2013233795 A * 11/2013 ..... B41J 2/14
JP 2018043425 A * 3/2018 ..... B41J 2/335
JP 2019031057 A 2/2019

* cited by examiner

*Primary Examiner* — Yaovi M Ameh
(74) *Attorney, Agent, or Firm* — Hamre, Schumann, Mueller & Larson, P.C.

(57) ABSTRACT

The present disclosure provides a thermal print head for achieving fine printing. A thermal print head of the disclosure includes: a substrate, having a substrate main surface and a substrate back surface facing opposite sides in a z direction; a resistor layer, disposed on a side of the substrate main surface and including a plurality of heat generating portions arranged in a main scan direction to generate heat by energization; a wiring layer, disposed on the side of the substrate main surface and including a conduction path for electrically conducting the plurality of heat generating portions; a metal layer, interposed between the substrate and the wiring layer with the resistor layer; and an insulating layer, interposed between the metal layer and the wiring layer with the resistor layer. The conduction path includes the metal layer. The metal layer includes tantalum (Ta).

18 Claims, 21 Drawing Sheets

THERMAL PRINT HEAD

BACKGROUND OF THE INVENTION

Field of the Invention

The disclosure relates to a thermal print head.

Description of the Prior Art

It is well-known that a conventional thermal print head includes a substrate, a resistor layer and a wiring layer. For example, patent publication 1 discloses the thermal print head above. In the thermal print head disclosed by the publication, a resistor layer and a wiring layer are formed on a substrate. The resistor layer has a plurality of heat generating portions arranged in a main scan direction. The wiring layer includes individual electrodes, a common electrode and a connecting portion. One end of each heat generating portion is connected to the individual electrode or the common electrode. Moreover, the other end of each of two adjacent heating generating portions is connected to the common connecting portion. Since one individual electrode energizes two heat generating portions, one point includes two heat generating portions.

In the configuration above, if miniaturization and gap narrowing of heat generating portions are desired in the aim of finer printing, the electrodes of the wiring layer need to be more finely formed. However, finely forming the wiring layer contains limitations.

PRIOR ART DOCUMENT

Patent Publication

[Patent publication 1] Japan Patent Publication No. 2019-31057

SUMMARY

Problems to be Solved by the Invention

The disclosure is conceived of on the basis of the situation above, with the goal of providing a thermal print head achieving fine printing.

Technical Means for Solving the Problem

A thermal print head of the disclosure includes: a substrate, having a substrate main surface and a substrate back surface facing opposite sides in a thickness direction; a resistor layer, disposed on a side of the substrate main surface and including a plurality of heat generating portions arranged in a main scan direction to generate heat by energization; a wiring layer, disposed on the side of the substrate main surface and including a conduction path for electrically conducting the plurality of heat generating portions; a metal layer, interposed between the substrate and the wiring layer with the resistor layer; and an insulating layer, interposed between the metal layer and the wiring layer with the resistor layer. The conduction path includes the metal layer, and the metal layer includes tantalum (Ta).

Effects of the Disclosure

According to the thermal print head of the disclosure, fine printing can be achieved.

Other features and advantages of the disclosure will become more readily apparent in the detailed description with reference to the accompanying drawings below.

DETAILED DESCRIPTION OF THE EMBODIMENTS

Figure 1:
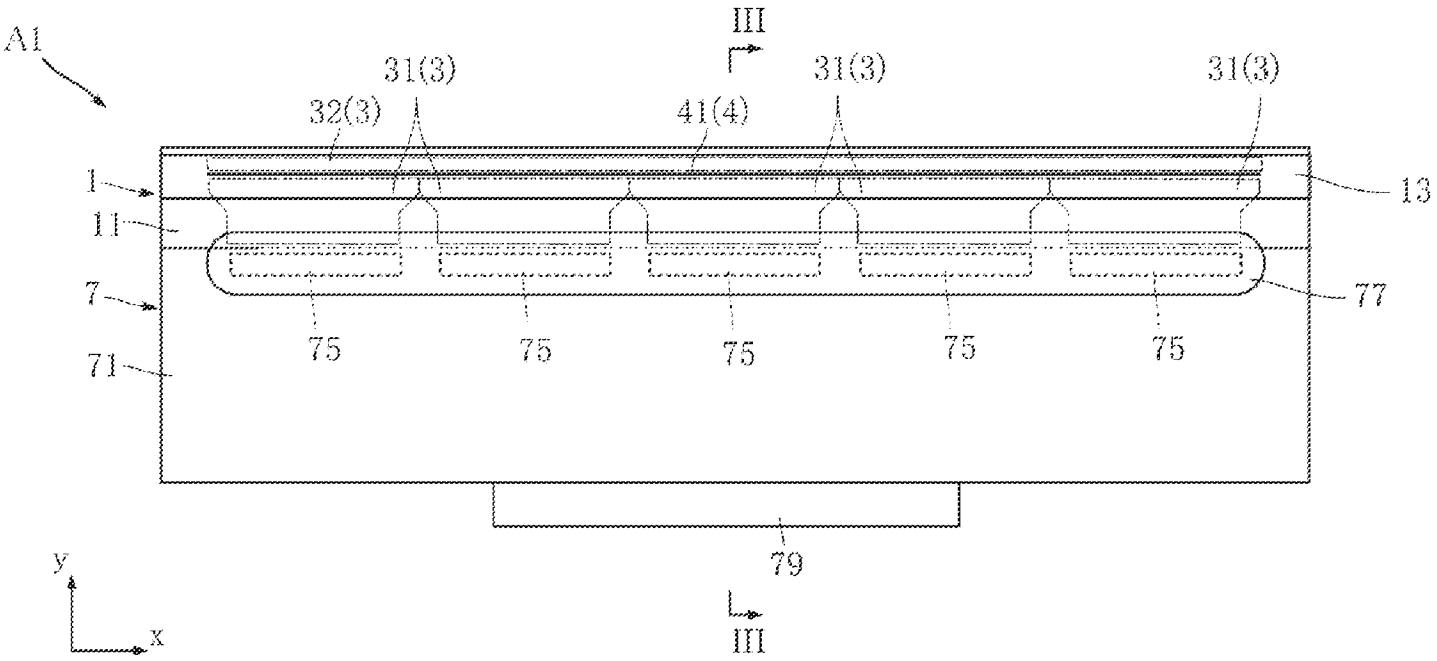
FIG. 1 is a top view of a thermal print head according to a first embodiment of the disclosure.

Details of the preferred embodiments of the disclosure are specifically described with reference to the accompanying drawings below.

First Embodiment

FIG. 1 to FIG. 6 show a thermal print head according to a first embodiment of the disclosure. A thermal print head A1 of this embodiment includes: a substrate 1, a substrate insulating layer 18, an insulating layer 2, a wiring layer 3, a resistor layer 4, a reduction layer 49, an insulative protection layer 5, a surface protection layer 59, a metal layer 6, a second substrate 7, a plurality of control elements 75, a plurality of lead wires 76, a protective resin 77, a connector 79 and a support component 8. The thermal print head A1 is assembled in a printer which prints on a printing medium (not shown) sandwiched and transported between pressure feed rollers 99. The printing medium may be, for example, thermal paper for making a barcode slip or a receipt.

Figure 2:
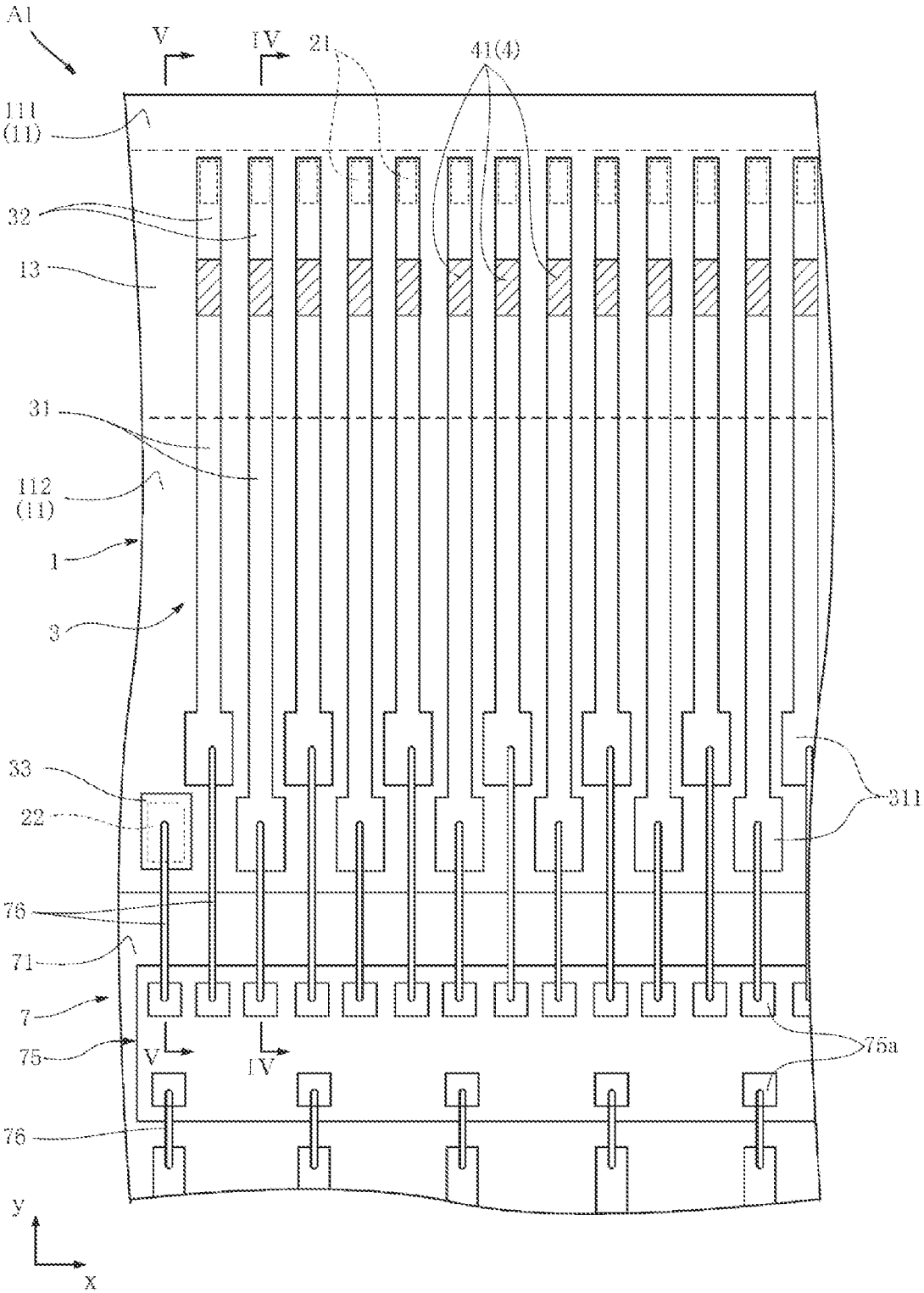
FIG. 2 is an enlarged top view of a main part of the thermal print head in FIG. 1.
Figure 3:
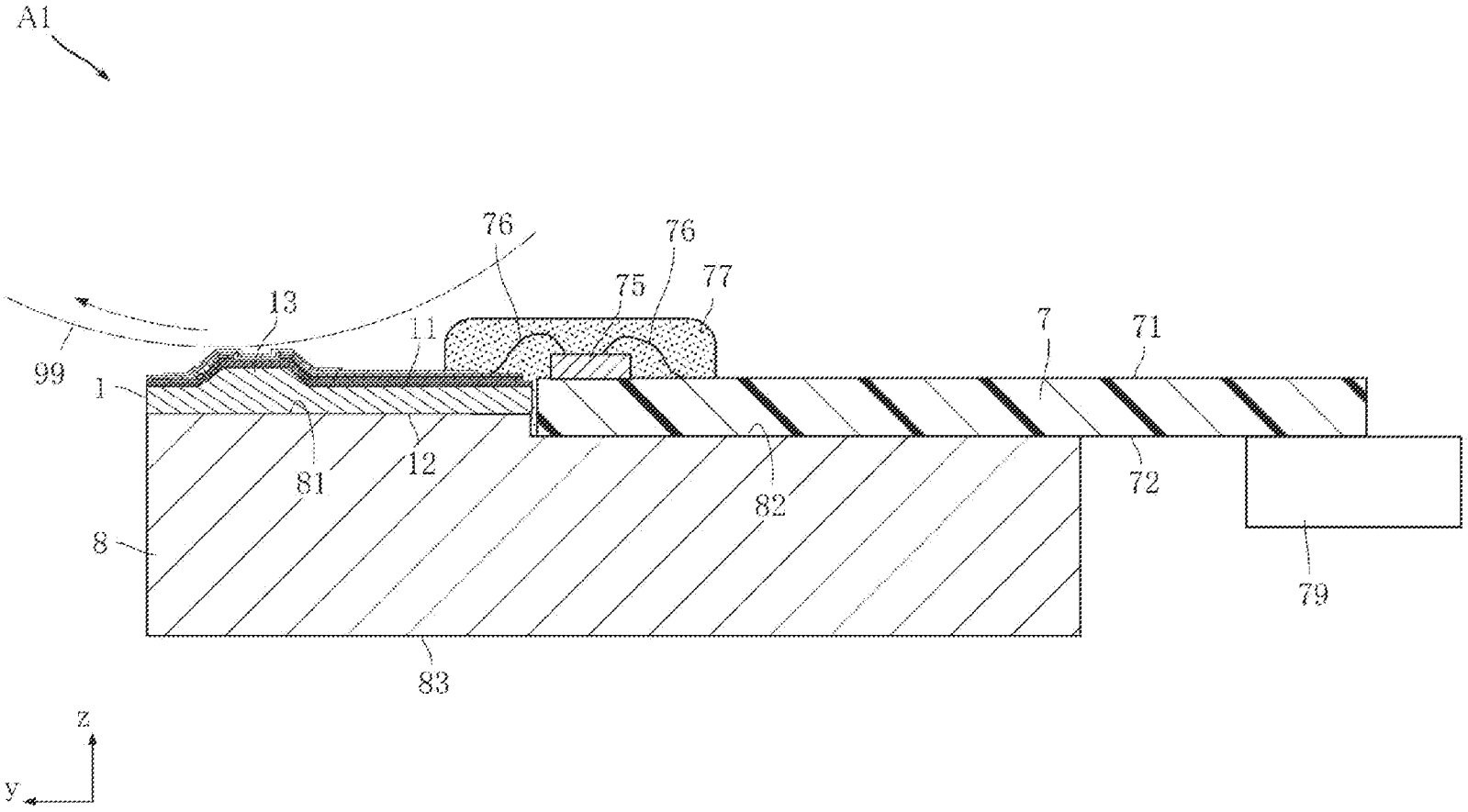
FIG. 3 is a sectional diagram taken along the line III-III in FIG. 1.
Figure 4:
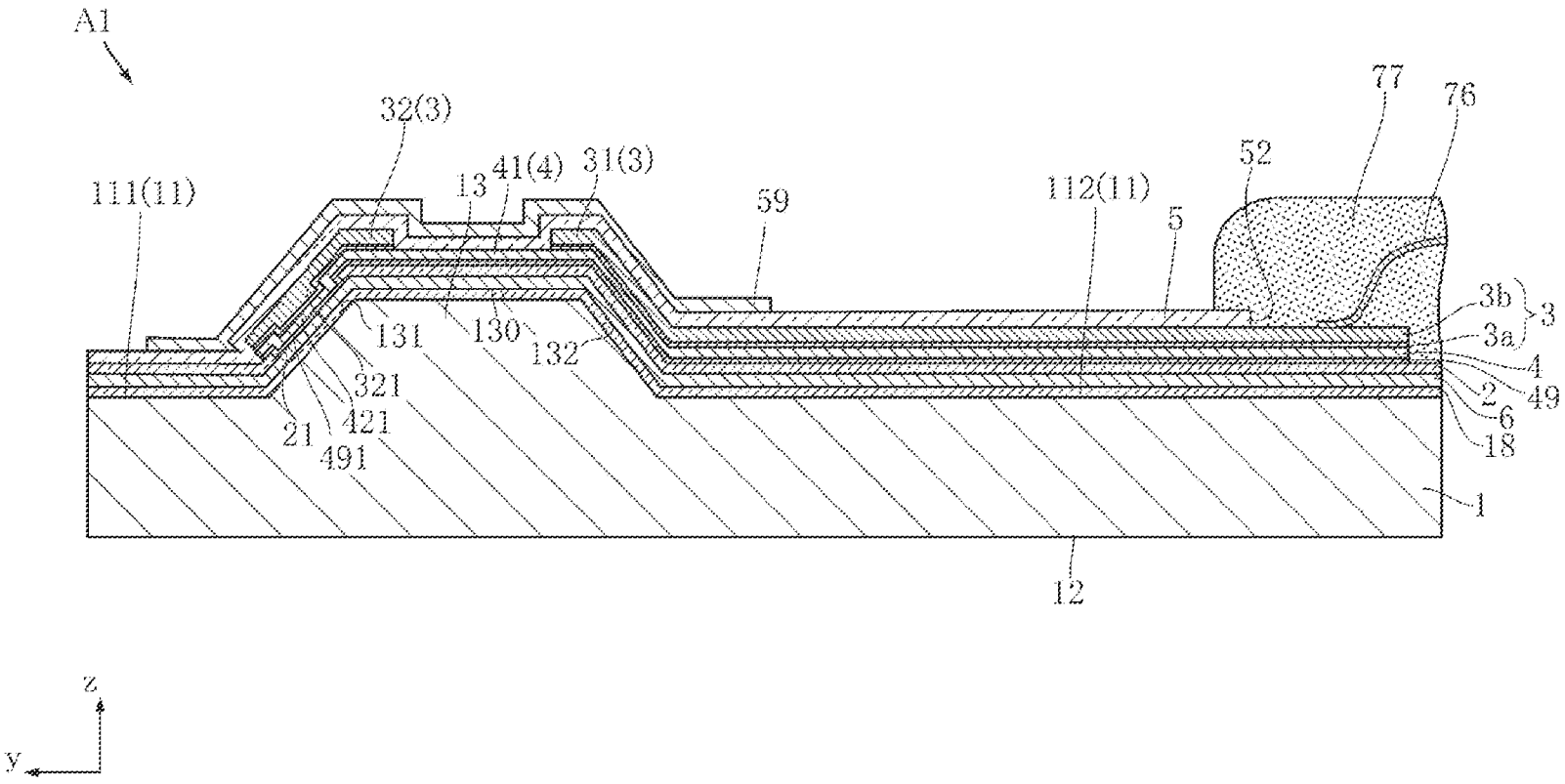
FIG. 4 is an enlarged sectional diagram of the main part taken along the line IV-IV in FIG. 2.
Figure 5:
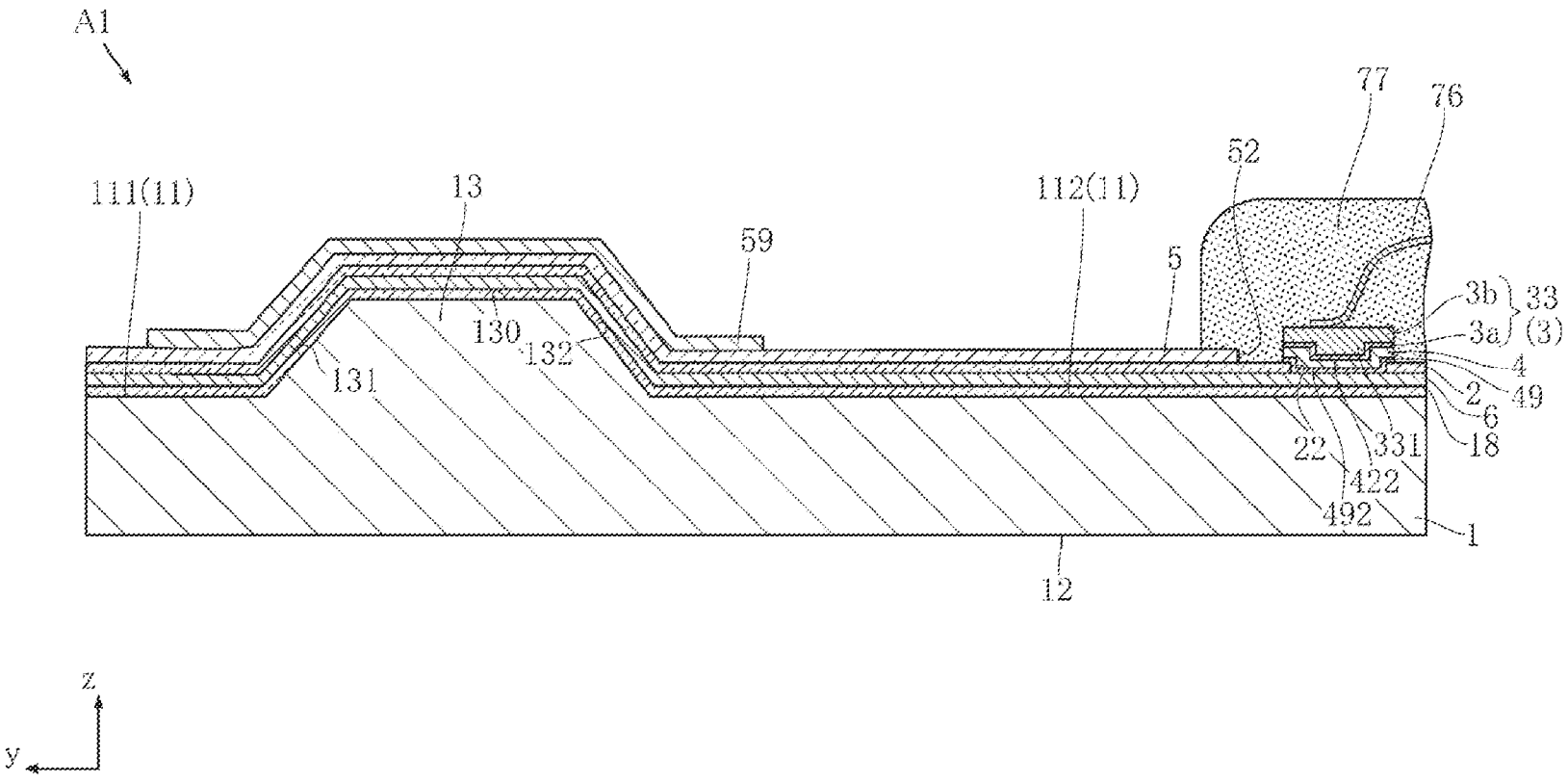
FIG. 5 is an enlarged sectional diagram of the main part taken along the line V-V in FIG. 2.
Figure 6:
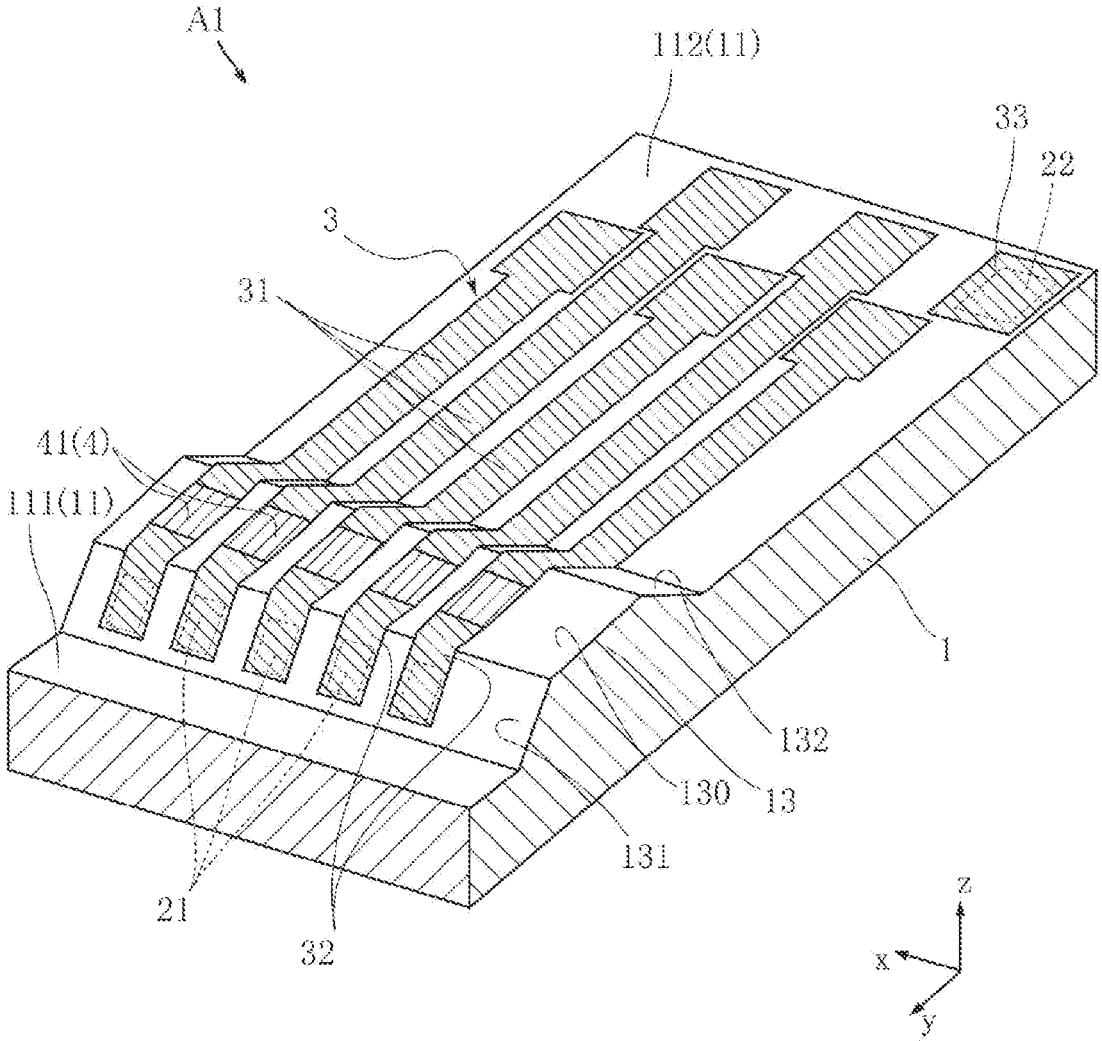
FIG. 6 is an enlarged three-dimensional diagram of the main part of the thermal print head in FIG. 1.

FIG. 1 shows a top view of the thermal print head A1. FIG. 2 shows an enlarged top view of a main part of the thermal print head A1. FIG. 3 shows a sectional diagram taken along the line 111-111 in FIG. 1. FIG. 4 shows an enlarged sectional diagram of the main part taken along the line IV-IV in FIG. 2. FIG. 5 shows an enlarged sectional diagram of the main part taken along the line V-V in FIG. 2. FIG. 6 shows an enlarged three-dimensional diagram of the main part of the thermal print head A1. In FIG. 1 and FIG. 2, for better understanding, the insulative protection layer 5 and the surface protection layer 59 are omitted. In FIG. 2, for better understanding, the protective resin 77 is omitted. In FIG. 4 and FIG. 5, for better understanding, the support component 8 and the second substrate 7 are omitted. Moreover, in FIG. 6, for better understanding, only the substrate 1, the wiring layer 3, the resistor layer 4 as well as a common electrode first opening 21 and a common electrode second opening 22 of the insulating layer 2 described below, are depicted. In these drawings, the description is given by setting a length direction (a main scan direction) of the substrate 1 as an x direction, a width direction (a secondary scan direction) as a y direction, and a thickness direction as a z direction. In the y direction, the bottom of FIG. 1 and FIG. 2 (the right of FIG. 3 to FIG. 5) is set as an upstream where a transported printing medium arrives, and the top of FIG. 1 and FIG. 2 (the left of FIG. 3 to FIG. 5) is set as a downstream where the printing medium is discharged. The same applies to the following drawings.

The substrate 1 supports the wiring layer 3 and the resistor layer 4. The substrate 1 is shaped as an elongated rectangle having the x direction as the length direction and the y direction as the width direction. The dimensions of the substrate 1 are not specifically limited, for example, the thickness (the dimension in the z direction) of the substrate 1 is approximately 0.4 mm to 1 mm. Moreover, the dimension of the substrate 1 in the x direction is, for example, approximately 30 mm to 230 mm (in terms of a printing width, equivalent to approximately 1 inch to 8 inches (25.4 mm to 203.2 mm)), and the dimension of the substrate 1 in the y direction is, for example, approximately 2 mm to 5 mm.

In this embodiment, the substrate 1 is made of a single crystal semiconductor, for example, formed of Si. As shown in FIG. 3 to FIG. 5, the substrate 1 has a substrate main surface 11, a substrate back surface 12, and a convex portion 13. Moreover, the substrate 1 may also be configured as excluding the convex portion 13. The substrate main surface 11 and the substrate back surface 12 face opposite sides in the z direction, and are parallel to each other. The substrate main surface 11 is a surface facing an upper side in FIG. 3 to FIG. 5. The substrate main surface 1I has a first region 111 and a second region 112 separated from each other to sandwich the convex portion 13 in the y direction. The first region 111 is disposed on the downstream side in the y direction, and the second region 112 is disposed on the upstream side in the y direction. The substrate back surface 12 is a surface facing a lower side in FIG. 3 to FIG. 5.

The convex portion 13 is a portion protruding in the z direction from the substrate main surface 11. The convex portion 13 extends long in the x direction. The convex portion 13 has a top surface 130, a first inclined side surface 131 and a second inclined side surface 132. The top surface 130 is parallel to the substrate main surface 11, and is spaced from the substrate main surface 11 in the thickness direction. The first inclined side surface 131 is interposed between the top surface 130 and the first region 111, and inclines relative to the substrate main surface 11. The second inclined side surface 132 is interposed between the top surface 130 and the second region 112, and inclines relative to the substrate main surface 11.

In this embodiment, a (100) surface is selected as the substrate main surface 11. In this embodiment, the convex portion 13 is formed by performing anisotropic etching using, for example, potassium hydroxide (KOH) on a (100) surface formed of a substrate material. The first inclined side surface 131 and the second inclined side surface 132 are angled the same from the top surface 130 and the substrate main surface 11, for example, at 54.7 degrees. Moreover, the shape of the convex portion 13 is not limited. For example, etching of the entire surface may be further performed using tetramethylammonium hydroxide (TMAH), so that the convex portion 13 becomes a shape having an inclined side surface between the top surface 130 and the first inclined side surface 131, and between the top surface 130 and the second inclined side surface 132.

As shown in FIG. 4 and FIG. 5, the substrate insulating layer 18 covers all of the substrate main surface 11 of the substrate 1, the top surface 130, the first inclined side surface 131 and the second inclined side surface 132. In this embodiment, the substrate main surface 11 of the substrate 1, the top surface 130, the first inclined side surface 131 and the second inclined side surface 132 are not exposed from the substrate insulating layer 18. The substrate insulating layer 18 includes an insulative material, for example including silicon dioxide ($SiO_2$) or silicon nitride (SiN). The substrate insulating layer 18 may be, for example, a silicon dioxide ($SiO_2$) layer with tetraethyl orthosilicate (TEOS) as the raw material. Moreover, the material of the substrate insulating layer 18 is not limited. The thickness of the substrate insulating layer 18 is similarly not specifically limited, and is, for example, 5 μm to 50 μm, preferably approximately 15 μm.

The metal layer 6 is a layer containing an electrically conductive metal, and covers the entire substrate insulating layer 18. The metal layer 6 is included in a conduction path for electrically conducting heat generating portions 41 below. In addition, as described below, the metal layer 6 has a part overlapping with the heat generating portions 41 when viewed from the z direction. The heat generating portions 41 may be extremely high in temperature due to energization, and the instantaneous temperature may sometimes reach as high as 700° C. When the melting point of the metal layer 6 is low, the heat released by the heat generating portions 41 may cause damage in the metal layer 6. Moreover, when the thermal conductivity of the metal layer 6 is high, heat to be stored in the insulating layer 2 is overly released. Thus, the material of the metal layer 6 needs to have a high melting point and a low thermal conductivity. In this embodiment, the metal layer 6 includes tantalum (Ta). Moreover, in this embodiment, α-Ta having a body-centered cubic lattice structure in Ta and relatively low resistance is used. The thickness of the metal layer 6 is not specifically limited, and is, for example, 0.5 μm to 5 μm, preferably approximately 1 μm. In this embodiment, the metal layer 6 covers entirely the substrate main surface 1I and the convex portion 13 of the substrate 1.

As shown in FIG. 4 and FIG. 5, the insulating layer 2 is interposed between the metal layer 6 and the wiring layer 3 with the resistor layer 4. The insulating layer 2 includes an insulative material, for example, including $SiO_2$ or SiN. The insulating layer 2 may be, for example, a $SiO_2$ layer with TEOS as the raw material. Moreover, the material of the insulating layer 2 is not limited. The thickness of the insulating layer 2 is similarly not specifically limited, and is, for example, 0.5 μm to 2 μm, preferably approximately 1 μm.

The insulating layer 2 has a plurality of common electrode first openings 21 (referring to FIG. 4) and a plurality of common electrode second openings 22 (referring to FIG. 5). Each common electrode first opening 21 and each common electrode second opening 22 pass through the insulating layer 2 in the z direction. In this embodiment, the plurality of common electrode first openings 21 overlap with the first inclined side surface 131 when viewed from the z direction. As shown in FIG. 2 and FIG. 6, each common electrode first opening 21 overlaps with any of a plurality of common electrodes 32 described below when viewed from the z direction. Moreover, in this embodiment, the plurality of common electrode second openings 22 overlap with the second region 112 when viewed from the z direction. As shown in FIG. 2 and FIG. 6, each common electrode second opening 22 overlaps with any of a plurality of common electrodes 33 described below when viewed from the z direction.

The resistor layer 4 is supported by the substrate 1, and is formed over the insulating layer 2 in this embodiment. The resistor layer 4 has a plurality of heat generating portions 41. The plurality of heat generating portions 41 partially heat the printing medium by individual selective energization, and are each equivalent to one point (a dot) formed on the printing medium. The plurality of heat generating portions 41 are in a linear arrangement in the x direction serving as the main scan direction. The plurality of heat generating portions 41 in the linear arrangement are in their entirety equivalent to one row formed on the printing medium. The plurality of heat generating portions 41 are regions in the resistor layer 4 exposed from the wiring layer 3, and are in a spaced arrangement in the x direction. In this embodiment, the plurality of heat generating portions 41 overlap with the convex portion 13 when viewed from the z direction, and more specifically, all of the plurality of heat generating portions 41 overlap with the top surface 130. The shape of the heat generating portions 41 is not specifically limited, and is an elongated rectangle having the y direction as the length direction when viewed from the z direction in this embodiment. The resistor layer 4 is made of, for example, TaN. The thickness of the resistor layer 4 is not specifically limited, and is, for example, 0.03 μm to 0.2 μm, preferably approximately 0.05 μm.

In this embodiment, the resistor layer 4 has a resistor layer first through conducting portion 421 (referring to FIG. 4) and a resistor layer second through conducting portion 422 (referring to FIG. 5). The resistor layer first through conducting portion 421 is a part that overlaps with the common electrode first opening 21 of the insulating layer 2 when viewed from the z direction, and is electrical connected to the metal layer 6 through the reduction layer 49. The resistor layer second through conducting portion 422 is a part that overlaps with the common electrode second opening 22 of the insulating layer 2 when viewed from the z direction, and is electrically connected to the metal layer 6 through the reduction layer 49.

The reduction layer 49 is laminated between the insulating layer 2 and the resistor layer 4. The reduction layer 49 has a reduction layer first through conducting portion 491 and a reduction layer second through conducting portion 492. The reduction layer first through conducting portion 491 is connected to the metal layer 6 through the common electrode first opening 21, and is electrically connected to the metal layer 6. Moreover, the reduction layer first through conducting portion 491 is connected to the resistor layer first through conducting portion 421 of the resistor layer 4, and is electrically connected to the resistor layer first through conducting portion 421. That is to say, at the position of the common electrode first opening 21, the reduction layer first through conducting portion 491 is interposed between the resistor layer first through conducting portion 421 and the metal layer 6, and is connected to the resistor layer first through conducting portion 421 and the metal layer 6, so as to electrically connect the resistor layer first through conducting portion 421 to the metal layer 6. The reduction layer second through conducting portion 492 is connected to the metal layer 6 through the common electrode second opening 22, and is electrically connected to the metal layer 6. Moreover, the reduction layer second through conducting portion 492 is connected to the resistor layer second through conducting portion 422 of the resistor layer 4, and is electrically connected to the resistor layer second through conducting portion 422. That is to say, at the position of the common electrode second opening 22, the reduction layer second through conducting portion 492 is interposed between the resistor layer second through conducting portion 422 and the metal layer 6, and is connected to the resistor layer second through conducting portion 422 and the metal layer 6, so as to electrically connect the resistor layer second through conducting portion 422 to the metal layer 6.

The reduction layer 49 is configured to decompose by reduction a natural oxide film formed on the surface of the metal layer 6, so as to form ohmic connection between the resistor layer 4 and the metal layer 6. The metal layer 6 is in ohmic connection with the resistor layer first through conducting portion 421 by interposing the reduction layer first through conducting portion 491 using the part exposed from the common electrode first opening 21. Moreover, the metal layer 6 is in ohmic connection with the resistor layer second through conducting portion 422 by interposing the reduction layer second through conducting portion 492 using the part exposed from the common electrode second opening 22. In this embodiment, the reduction layer 49 includes, for example, titanium (Ti). Moreover, the material of the reduction layer 49 is not limited. The thickness of the reduction layer 49 is likewise not specifically limited, and is, for example, approximately 0.02 μm to 0.2 μm. In this embodiment, because the reduction layer 49 further serves as a part of a conduction path, the thickness thereof is thicker, and is approximately 0.2 μm.

The wiring layer 3 is used to form a conduction path that electrically conducts the plurality of heat generating portions 41. The wiring layer 3 is supported by the substrate 1, and is laminated on the resistor layer 4 in this embodiment, as shown in FIG. 4 and FIG. 5. The wiring layer 3 exposes parts of the resistor layer 4 to be the heat generating portions 41. The wiring layer 3 includes a metal material having a resistance lower than that of the resistor layer 4. The wiring layer 3 has a first layer 3*a* and a second layer 3*b*. The first layer 3*a* is disposed on a side of the substrate 1, and has a lower thermal conductivity. The first layer 3*a* is made of, for example, Ti. The thickness of the first layer 3*a* is not specifically limited, and is, for example, approximately 0.1 μm to 0.2 μm. The second layer 3*b* is laminated on the first layer 3*a*, and has a higher thermal conductivity. The second layer 3*b* is made of, for example, copper (Cu). The thickness of the second layer 3*b* is not specifically limited, and is, for example, approximately 0.3 μm to 0.5 μm. Moreover, the wiring layer 3 may exclude the first layer 3*a*, and consists of the second layer 3*b* only.

As shown in FIG. 2, the wiring layer 3 has a plurality of individual electrodes 31, a plurality of common electrodes 32, and a plurality of common electrodes 33. The plurality of individual electrodes 31 are connected to the plurality of heat generating portions 41, respectively. In this embodiment, the plurality of individual electrodes 31 are strips extending in the y direction, and are disposed on the upstream side in the y direction relative to the plurality of heat generating portions 41. Each individual electrode 31 has a pad 311. The pad 311 is a part disposed on an end portion on the upstream side in the y direction and is for bonding to the lead wire 76 for electrically connecting to the control element 75. One heat generating portion 41 is equivalent to one point (one dot) formed on the printing medium.

The plurality of common electrodes 32 are electrically connected to the plurality of common electrodes 33, and are electrically connected to all of the plurality of heat generating portions 41. The plurality of common electrodes 32 are connected to the plurality of heat generating portions 41, respectively. In this embodiment, the plurality of common electrodes 32 are strips extending in the y direction when viewed from the z direction, and are disposed on a side (equivalent to the downstream side in the y direction with respect to the plurality of heat generating portions 41) opposite to the plurality of individual electrodes 31 to sandwich the plurality of heat generating portions 41. Moreover, in this embodiment, the plurality of common electrodes 32 are disposed at the convex portion 13. It is understood from FIG. 2 and FIG. 4, in this embodiment, in the resistor layer 4, parts between the plurality of individual electrodes 31 and the plurality of common electrodes 32 exposed from the wiring layer 3 become the plurality of heat generating portions 41. Moreover, as shown in FIG. 4, each common electrode 32 has a wiring layer first through conducting portion 321. The wiring layer first through conducting portion 321 is a portion that overlaps with the common electrode first opening 21 of the insulating layer 2 when viewed from the z direction, and is connected to the resistor layer first through conducting portion 421 of the resistor layer 4. Thus, each common electrode 32 is electrically conducted to the metal layer 6 through the common electrode first opening 21 of the insulating layer 2, the resistor layer first through conducting portion 421 and the reduction layer first through conducting portion 491.

The plurality of common electrodes 33 are shaped as rectangles when viewed from the z direction, and are disposed on an end portion of the upstream side of the second region 112. The plurality of common electrodes 33 and a part of the plurality of pads 311 are arranged in the x direction. In addition, shapes and configuration positions of the plurality of common electrodes 33 when viewed from the z direction are not limited. Moreover, as shown in FIG. 5, each common electrode 33 has a wiring layer second through conducting portion 331. The wiring layer second through conducting portion 331 is a portion that overlaps with the common electrode second opening 22 of the insulating layer 2 when viewed from the z direction, and is connected to the resistor layer second through conducting portion 422 of the resistor layer 4. Thus, each common electrode 33 is electrically conducted to the metal layer 6 through the common electrode second opening 22 of the insulating layer 2, the resistor layer second through conducting portion 422 and the reduction layer second through conducting portion 492. As a result, the plurality of common electrodes 32 and the plurality of common electrodes 33 are all electrically connected through the metal layer 6. In this embodiment, the conduction path for electrically conducting the plurality of heat generating portions 41 includes the wiring layer 3 and the metal layer 6. More specifically, the conduction path becomes a configuration in which a current from the common electrode 32 flows to the common electrode 33 through the metal layer 6.

The insulative protection layer 5 covers the wiring layer 3 and the resistor layer 4. The insulative protection layer 5 includes an insulative material, and protects the wiring layer 3 and the resistor layer 4. The material of the insulative protection layer 5 is, for example, $SiO_2$. The thickness of the insulative protection layer 5 is not specifically limited, and is, for example, approximately 0.8 μm to 5 μm, preferably approximately 3 μm.

The insulative protection layer 5 has a plurality of pad openings 52. The plurality of pad openings 52 pass through the insulative protection layer 5. The plurality of pad openings 52 overlap with the second region 112 when viewed from the z direction, and respectively expose the pads 311 of the plurality of individual electrodes 31 or the common electrodes 32.

The surface protection layer 59 overlaps with the plurality of heat generating portions 41 when viewed from the z direction, and is laminated on the insulative protection layer 5. The surface protection layer 59 includes a conductive material and an insulative material, and are sometimes these two materials, and for example, including silicon alu-minuet oxynitncle (SiAlON) and SIC. When the surface protection layer 59 includes an electrically conductive material, for example, electrical connection to a ground electrode (not shown) formed by exposing both ends in the x-direction from the insulative protection layer 5 can be accomplished. Accordingly, charged electric charge in the surface protection layer 59 flows to the ground electrode, hence appropriately removing the electric charge from the surface protection layer 59. In addition, the surface protection layer 59 may also be formed of an insulative material. In this case, the ground electrode above may not be formed. The surface protection layer 59 is preferably formed of a wear-resistant material. The thickness of the surface protection layer 59 is not specifically limited, and is, for example, approximately 3 μm to 10 μm, preferably approximately 5 μm.

As shown in FIG. 1 to FIG. 3, the second substrate 7 is disposed on the upstream side in the y direction relative to the substrate 1. The second substrate 7 is, for example, a printed circuit board (PCB) substrate, on which the plurality of control elements 75 and the connector 79 are mounted.

The shape of the second substrate 7 is not specifically limited, and is a rectangle having the x direction as the length direction in this embodiment. The second substrate 7 has a second substrate main surface 71 and a second substrate back surface 72. The second substrate main surface 71 is a surface facing the same side as the substrate main surface 11 of the substrate 1, and the plurality of control elements 75 are fixed thereon by means of chip welding. The second substrate back surface 72 is a surface facing the same side as the substrate back surface 12 of the substrate 1, and the connector 79 is mounted thereon.

As shown in FIG. 1 to FIG. 3, the plurality of control elements 75 are mounted on the second substrate main surface 71 of the second substrate 7, and are for electrically conducting the plurality of heat generating portions 41, respectively. The plurality of control elements 75 are arranged in the x direction. As shown in FIG. 2, each control element 75 has a plurality of electrodes 75*a*. A part of the plurality of electrodes 75*a* are respectively connected to the pads 311 of the plurality of individual electrodes 31 by the lead wires 76. Moreover, one electrode 75*a* is connected to the common electrode 33 by the lead wire 76. Further, the remaining electrodes 75*a* are respectively connected to wires formed on the second substrate 7 by the lead wires 76. Energization control of the control elements 75 is performed according to an instruction signal inputted through the wire of the second substrate 7 from the outside of the thermal print head A1. In this embodiment, the plurality of control elements 75 are provided according to the number of the heat generating portions 41. As shown in FIG. 1 and FIG. 3, the plurality of control elements 75 and the plurality of lead wires 76 are covered by the protective resin 77. The protective resin 77 includes, for example, a thermosetting insulative resin such as epoxy resin, and is, for example, black. The protective resin 77 is formed in a manner of crossing the substrate 1 and the second substrate 7.

In addition, sometimes the control elements 75 do not include electrodes corresponding to the common electrodes 33 as the plurality of electrodes 75*a*. In this case, pads (preferably plural in quantity) used for the common electrodes 33 are disposed on the downstream side of two end portions in the second substrate 7 in the x direction, and these pads are connected to the common electrodes 33 by the lead wires 76.

The connector 79 is for connecting the thermal print head A1 to a control portion (not shown) included in a printer. The connector 79 is mounted on the second substrate back surface 72 of the second substrate 7, and is connected to wires formed on the second substrate 7.

The support component 8 supports the substrate 1 and the second substrate 7, and is for dissipating a part of the heat generated by the plurality of heat generating portions 41 through the substrate 1 to outside. The support component 8 is, for example, a block component including a metal such as A1. Moreover, the material of the support component 8 is not limited. As shown in FIG. 3, the support component 8 has a first support surface 81, a second support surface 82 and a bottom surface 83. The first support surface 81 and the second support surface 82 face an opposite side from the bottom surface 83 in the z direction. The first support surface 81 and the second support surface 82 face a same side as the substrate main surface 11 of the substrate 1, and are arranged side by side in the y direction. The first support surface 81 is disposed farther away from the bottom surface 83 than the second support surface 82 (closer to an upper side in FIG. 3). The first support surface 81 is bonded to the substrate back surface 12 of the substrate 1 by a bonding layer (not shown). The bonding layer is preferably a bonding layer that transmits the heat from the substrate 1 to the support component 8 and insulates the substrate 1 from the support component 8. The bonding layer is, for example, a resin-based adhesive. The second support surface 82 is bonded to the second substrate back surface 72 of the second substrate 7 by a bonding layer (not shown). The bottom surface 83 faces a same side as the substrate back surface 12 of the substrate 1. The bottom surface 83 is a reference surface used when the thermal print head A1 is assembled into the printer.

Next, details of an example of the manufacturing method of the thermal print head A1 are given with reference to FIG. 7 to FIG. 14 below.

Figure 7:
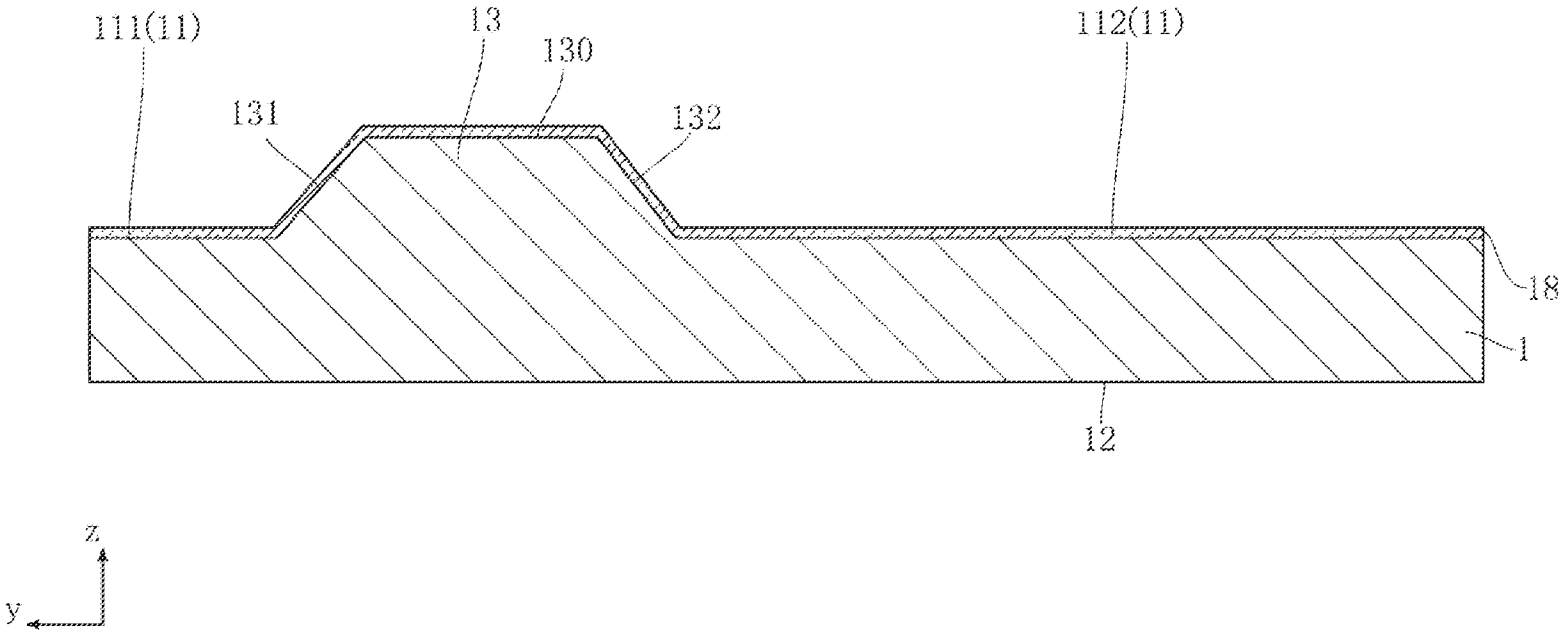
FIG. 7 is an enlarged sectional diagram of the main part in an example of a manufacturing method of the thermal print head in FIG. 1.

First of all, a substrate material is prepared. The substrate material is made of a single crystal semiconductor, for example, a Si wafer. Moreover, the substrate material has a (100) surface. After covering the (100) surface by a specific mask layer, anisotropic etching is performed using, for example, KOH. Accordingly, the substrate 1 shown in FIG. 7 can be obtained. Specifically speaking, the substrate 1 obtained in this step is in a state equivalent to that before forming the substrate insulating layer 18 in the substrate 1 in FIG. 7. The substrate main surface 11 and the top surface 130 are (100) surfaces. The first inclined side surface 131 and the second inclined side surface 132 are inclined surfaces formed by means of anisotropic etching, and are respectively angled from the substrate main surface 11 at 54.7 degrees. Moreover, the substrate 1 may also be formed by a different process from that of the method, for example, by cutting. Next, $SiO_2$ is deposited in a manner of covering the substrate main surface 11 and the convex portion 13 using chemical vapor deposition (CVD), and the substrate insulating layer 18 is formed on the substrate 1 as shown in FIG. 7.

Figure 8:
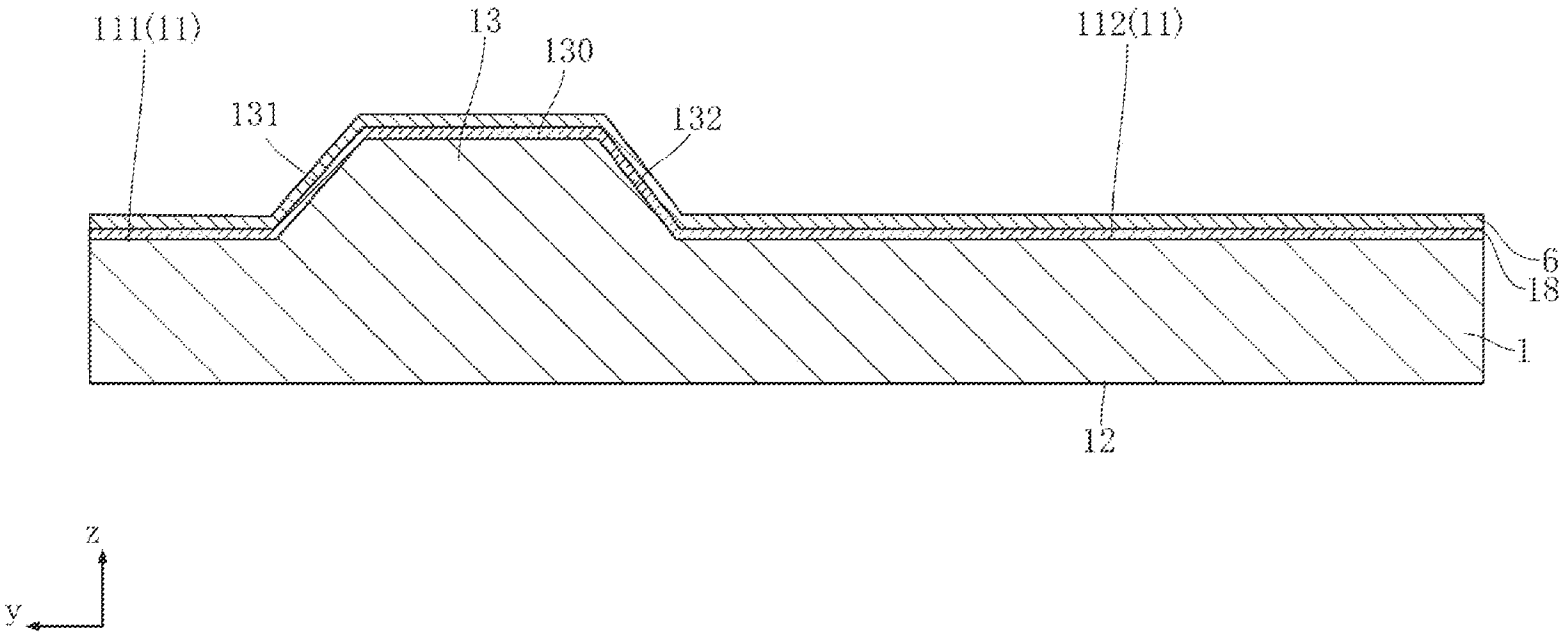
FIG. 8 is an enlarged sectional diagram of the main part in an example of a manufacturing method of the thermal print head in FIG. 1.

Next, as shown in FIG. 8, the metal layer 6 covering the substrate insulating layer 18 is formed by a thin film formation process such as CVD or sputtering. The metal layer 6 includes, for example, Ti (titanium).

Figure 9:
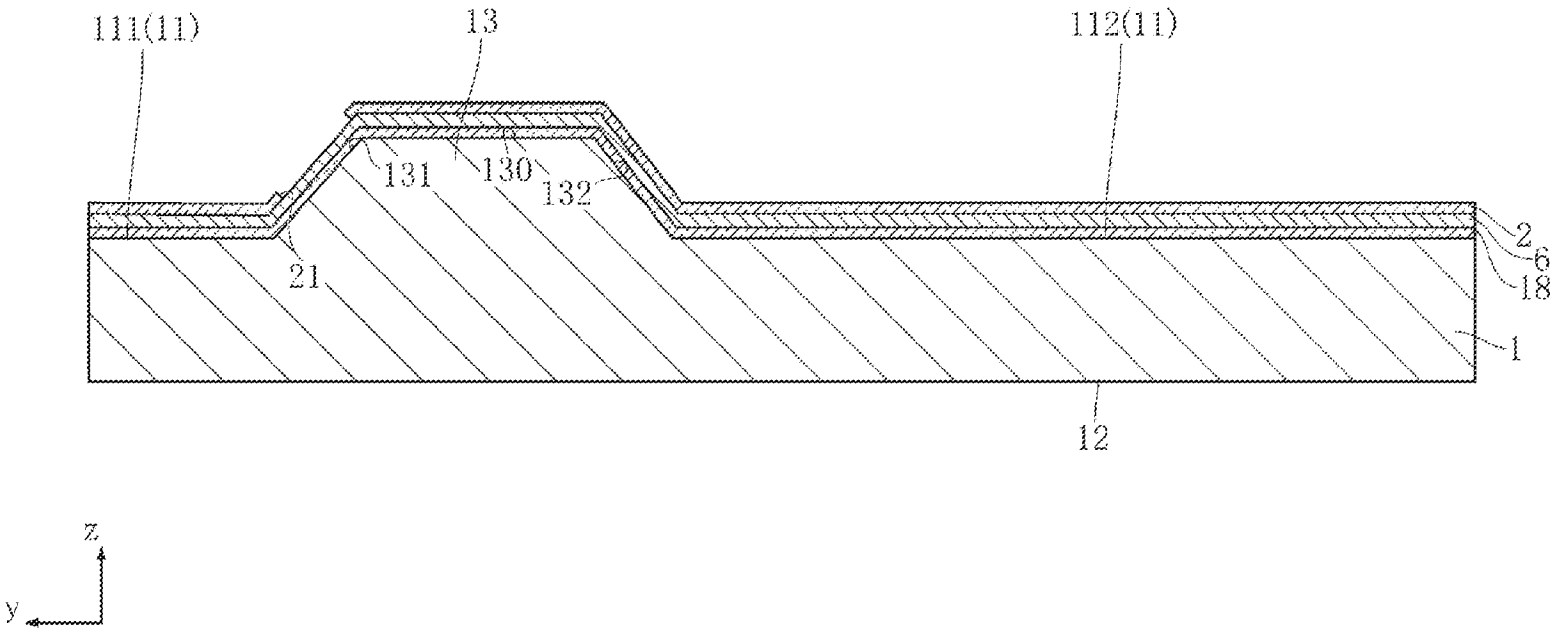
FIG. 9 is an enlarged sectional diagram of the main part in an example of a manufacturing method of the thermal print head in FIG. 1.

Next, as shown in FIG. 9, the insulating layer 2 is formed. The insulating layer 2 is formed by depositing $SiO_2$ by means of, for example, CVD. Moreover, the common electrode first opening 21 and the common electrode second opening 22 (not shown) are formed by such as etching. The metal layer 6 is exposed from the common electrode first opening 21 and the common electrode second opening 22.

Figure 10:
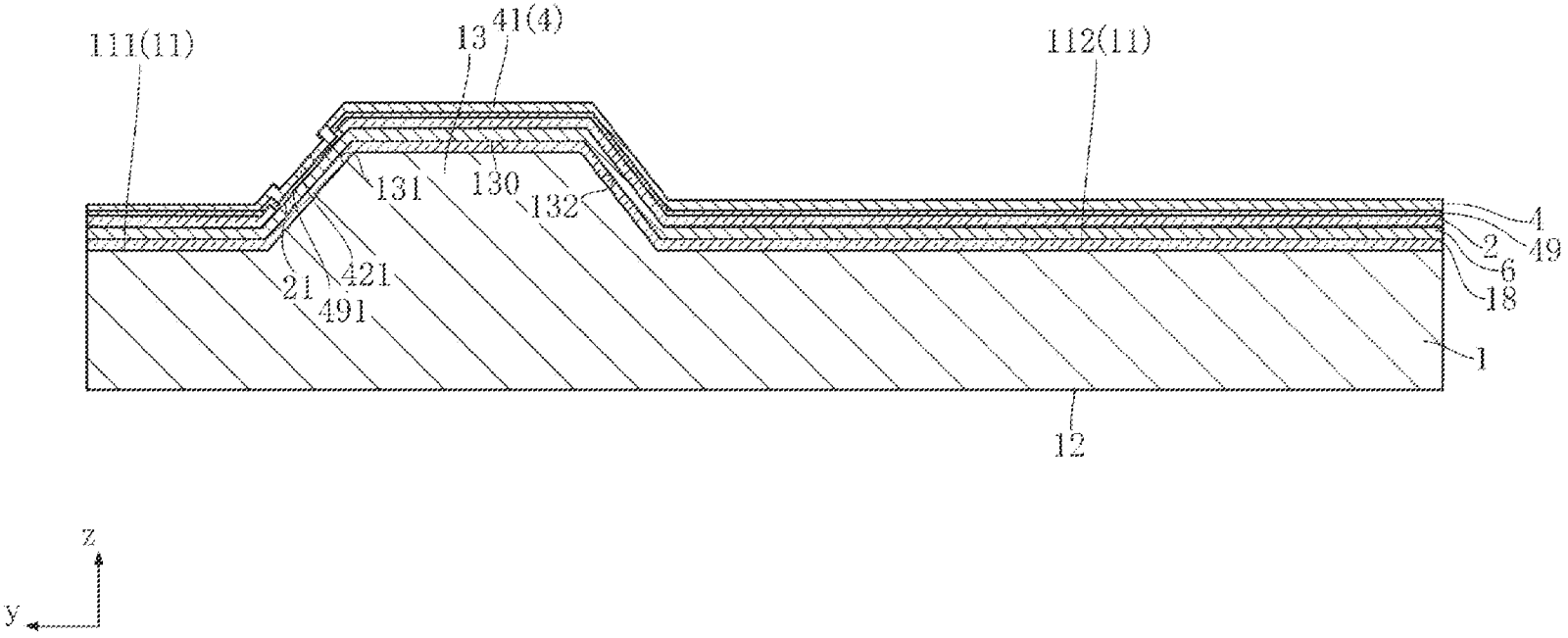
FIG. 10 is an enlarged sectional diagram of the main part in an example of a manufacturing method of the thermal print head in FIG. 1.
Figure 11:
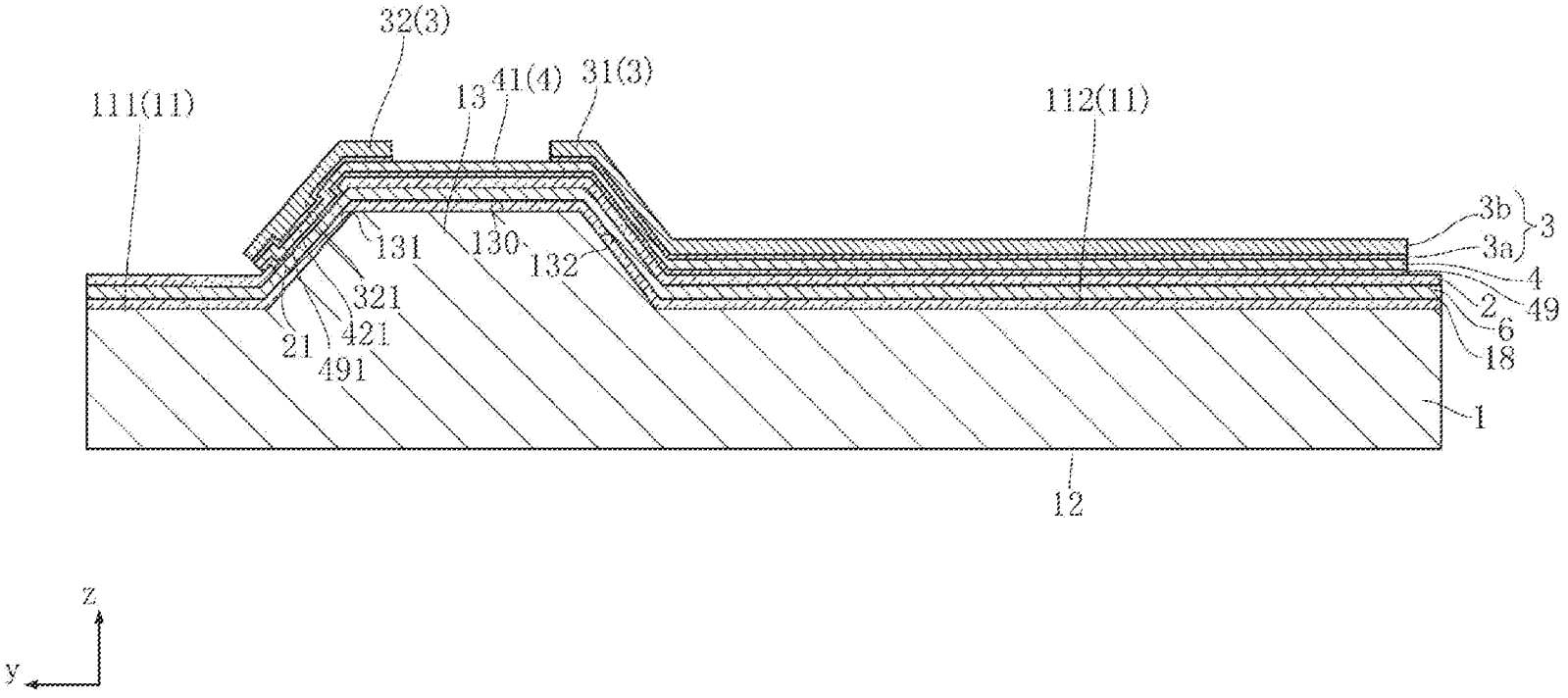
FIG. 11 is an enlarged sectional diagram of the main part in an example of a manufacturing method of the thermal print head in FIG. 1.

Next, as shown in FIG. 10, the reduction layer 49 and the resistor layer 4 are formed. The reduction layer 49 is formed by forming a Ti film over the insulating layer 2 by, for example, sputtering. In addition, the resistor layer 4 is formed by forming a TaN film over the reduction layer 49 by, for example, sputtering. A part of the reduction layer 49 overlapping with the common electrode first opening 21 becomes the reduction layer first through conducting portion 491, and a part of the reduction layer 49 overlapping with the common electrode second opening 22 becomes the reduction layer second through conducting portion 492 (not shown). Moreover, a part of the resistor layer 4 overlapping with the common electrode first opening 21 becomes the resistor layer first through conducting portion 421, and a part of the resistor layer 4 overlapping with the common electrode second opening 22 becomes the resistor layer second through conducting portion 422 (not shown).

Next, the wiring layer 3 covering the resistor layer 4 is formed. First of all, the first layer 3*a* is formed. The first layer 3*a* is formed by forming a Ti film over the resistor layer 4 by, for example, sputtering. Next, the second layer 3*b* covering the first layer 3*a* is formed. The second layer 3*b* is formed by forming a Cu-containing layer by, for example, coating or sputtering. Then, the wiring layer 3 is selectively etched and the resistor layer 4 and the reduction layer 49 are also selectively etched, so as to obtain the wiring layer 3 and the resistor layer 4 shown in FIG. 11. The wiring layer 3 has the plurality of individual electrodes 31, the plurality of common electrodes 32, and the plurality of common electrodes 33. The resistor layer 4 has a plurality of heat generating portions 41. A part of the common electrode 32 overlapping with the common electrode first opening 21 becomes the wiring layer first through conducting portion 321, and a part of the common electrode 33 (not shown) overlapping with the common electrode second opening 22 becomes the wiring layer second through conducting portion 331 (not shown).

Figure 12:
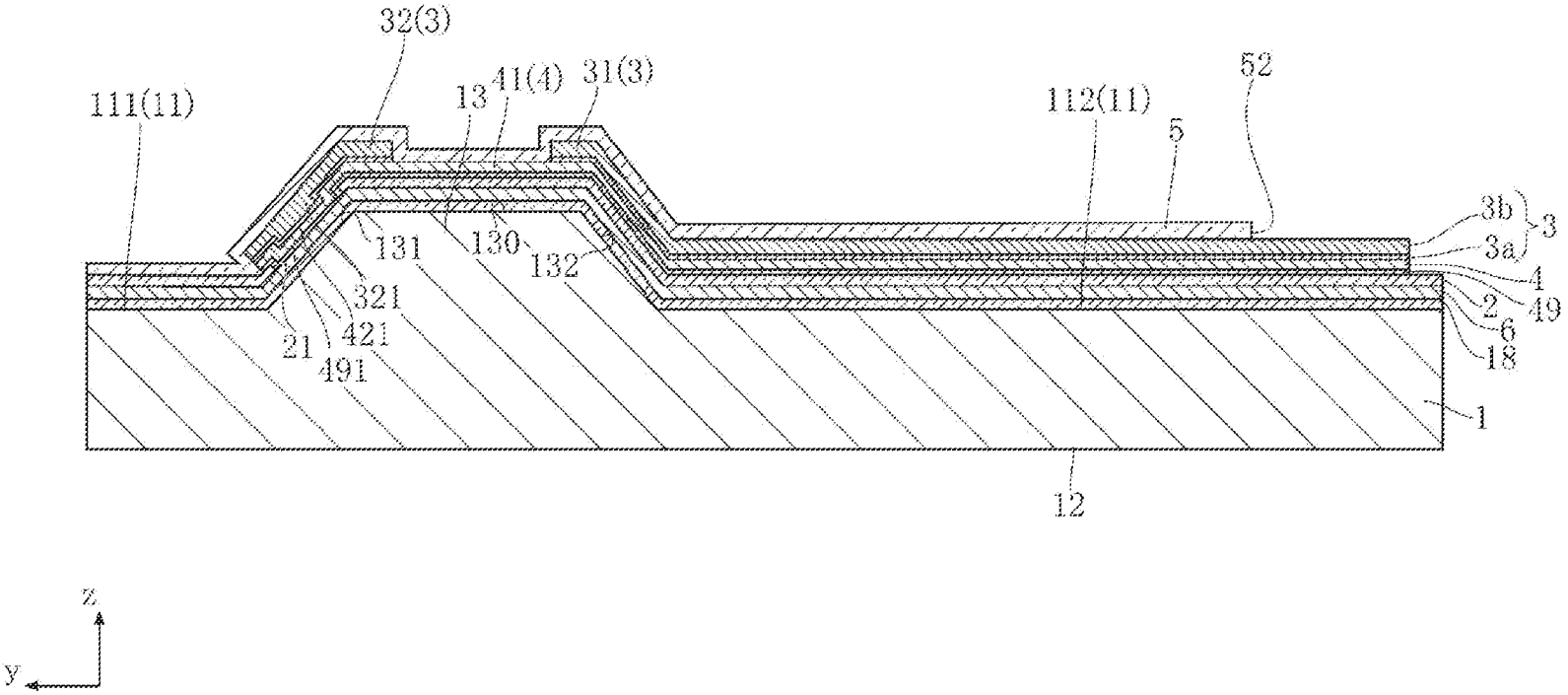
FIG. 12 is an enlarged sectional diagram of the main part in an example of a manufacturing method of the thermal print head in FIG. 1.
Figure 13:
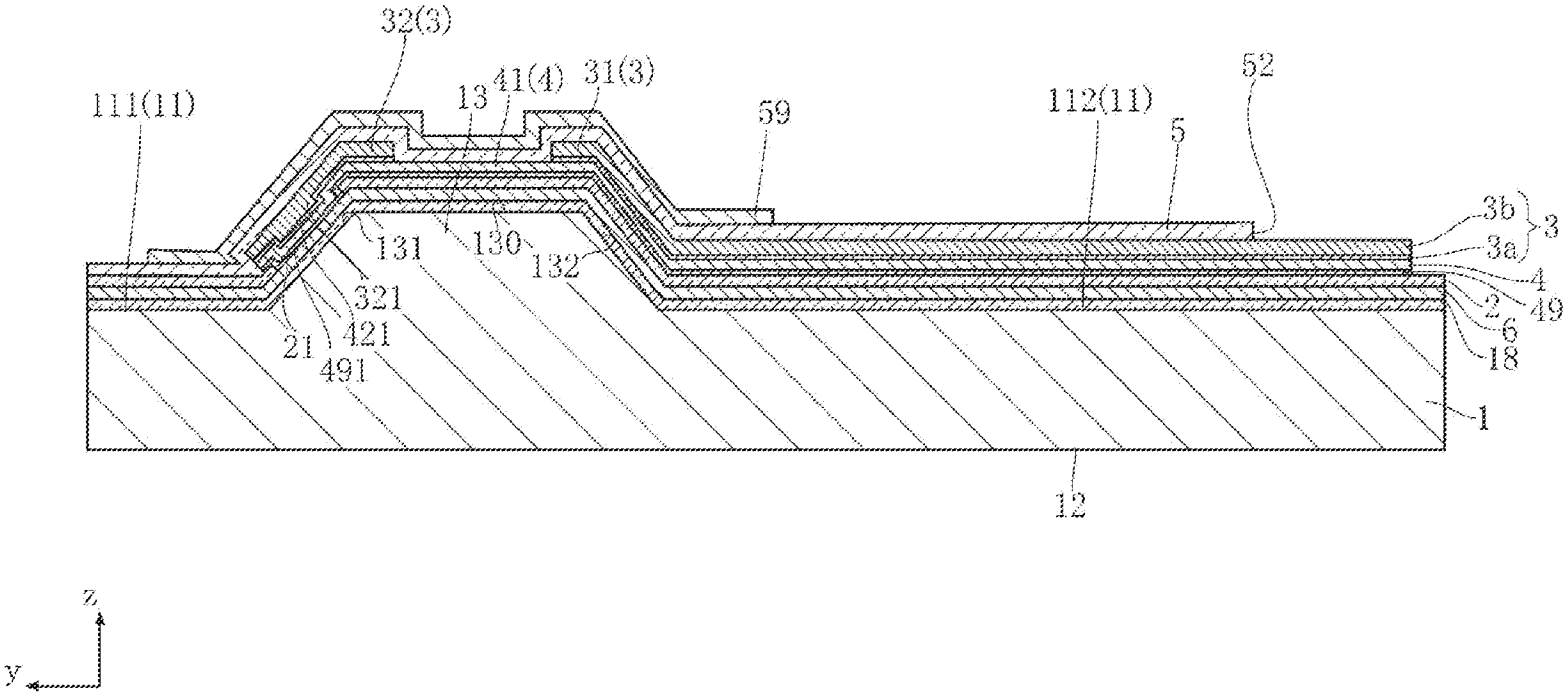
FIG. 13 is an enlarged sectional diagram of the main part in an example of a manufacturing method of the thermal print head in FIG. 1.

Next, as shown in FIG. 12, the insulative protection layer 5 is formed. Formation of the insulative protection layer 5 is carried out by performing steps of; depositing $SiO_2$ over the insulating layer 2, the wiring layer 3 and the resistor layer 4 by, for example, CVD, and performing etching. A part removed by etching becomes the pad opening 52. Next, as shown in FIG. 13, the surface protection layer 59 is formed. The surface protection layer 59 is formed by depositing, for example, SiC on the insulative protection layer 5 by, for example, CVD. The substrate 1 with the various layers formed is obtained by the above steps.

Figure 14:
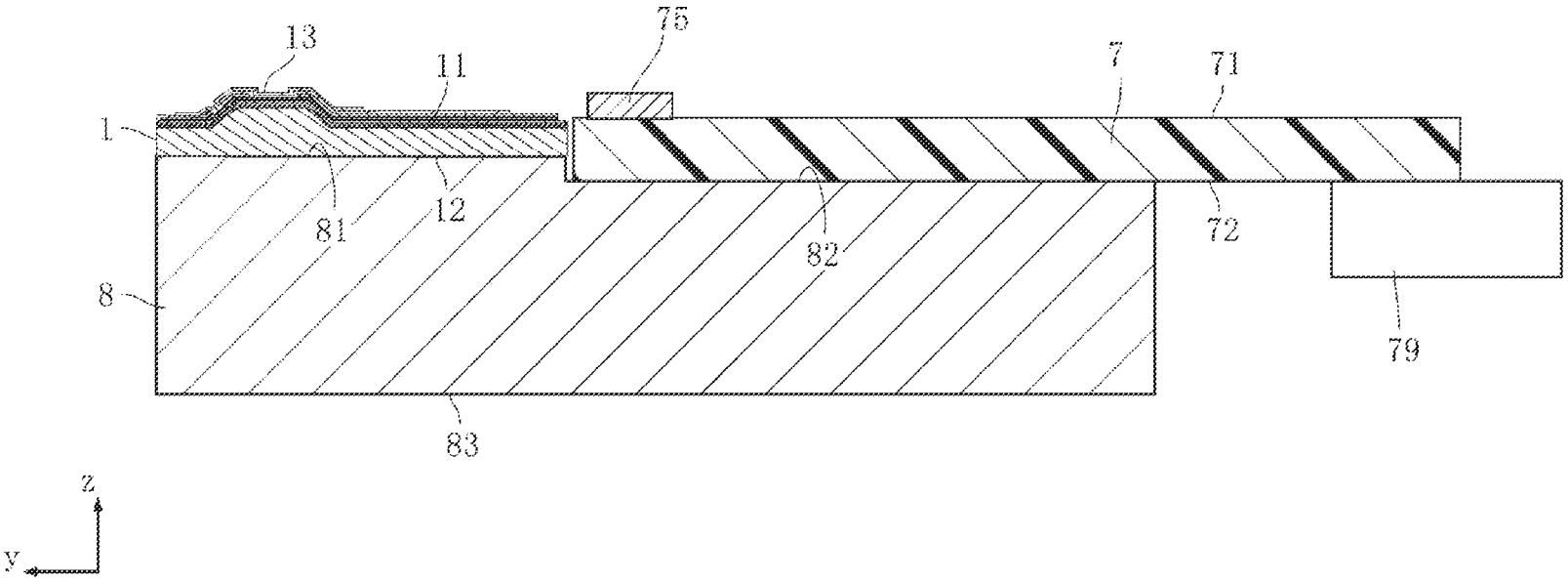
FIG. 14 is a sectional diagram of an example of a manufacturing method of the thermal print head in FIG. 1.

Next, as shown in FIG. 14, the substrate 1 and the second substrate 7 are mounted on the support component 8. The substrate 1 is bonded on the first support surface 81 of the support component 8 by the bonding layer in a manner of having the substrate back surface 12 face the first support surface 81. The second substrate 7 is bonded on the second support surface 82 of the support component 8 by the bonding layer in a manner of having the second substrate back surface 72 face the second support surface 82. The second substrate 7 is a PCB substrate with wires formed, the control elements 75 are mounted on the second substrate main surface 71, and the connector 79 is mounted on the second substrate back surface 72. Next, the lead wires 76 connecting the electrodes 75*a* of the control elements 75 to the wires formed on the wiring layer 3 or the second substrate 7 are formed. Then, the protective resin 77 covering the control elements 75 and the lead wires 76 is formed in a manner of crossing the substrate 1 and the second substrate 7. The thermal print head A1 is obtained by the steps above.

Next, effects of the thermal print head A1 are given below.

According to this embodiment, the conduction path for electrically conducting the plurality of heat generating portions 41 includes the metal layer 6. The common electrodes 32 connected to the heat generating portions 41 are disposed on a side opposite to the plurality of individual electrodes 31 to sandwich the plurality of heat generating portions 41, and are electrically connected to the common electrodes 33 disposed near the control elements 75 through the metal layer 6. Thus, compared to a situation in which a common electrode is disposed between the individual electrodes 31, the area of the wiring layer 3 to be disposed on the substrate main surface 11 of the substrate 1 can be reduced. Moreover, compared to a situation in which a common electrode bypassing the individual electrodes 31 is formed on the substrate main surface 11 of the substrate 1, the area of the wiring layer 3 to be disposed on the substrate main surface 11 of the substrate 1 can also be reduced. In addition, one heat generating portion 41 is equivalent to one point (one dot) formed on the printing medium. As a result, the extent of miniaturization of the electrodes needed for miniaturization and gap narrowing of the heat generating portions 41 can be alleviated. Therefore, fine printing is achieved.

Moreover, according to this embodiment, the metal layer 6 includes α-Ta. The melting point of Ta is 3,017° C. Thus, damage of the metal layer 6 caused by heat released from the heat generating portions 41 is inhibited. Moreover, because the thermal conductivity of Ta is about ⅙ of that of Cu, heat release is inhibited. Moreover, since the resistance of α-Ta is 15 to 60 μΩ·cm, energization is minimally affected.

Moreover, according to this embodiment, the Ti-containing reduction layer 49 is laminated between the insulating layer 2 and the resistor layer 4. At the position of the common electrode first opening 21, the reduction layer first through conducting portion 491 is interposed between the resistor layer first through conducting portion 421 and the metal layer 6. Accordingly, the resistor layer first through conducting portion 421 is in ohmic connection with the metal layer 6, allowing resistance characteristics to become common linear characteristics. Thus, more smooth electrical conduction can be realized. At the position of the common electrode second opening 22, the reduction layer second through conducting portion 492 is interposed between the resistor layer second through conducting portion 422 and the metal layer 6. Accordingly, the resistor layer second through conducting portion 422 is in ohmic connection with the metal layer 6, allowing resistance characteristics to become common linear characteristics. Thus, more smooth electrical conduction can be realized.

Moreover, according to this embodiment, the common electrode first opening 21 is formed at a position overlapping with the first inclined side surface 131, and the plurality of common electrodes 32 are disposed at the convex portion 13. Thus, compared to a situation in which the common electrode first opening 21 is formed at a position overlapping with the first region 111, the dimension of the first region 111 in the y direction can be reduced. Accordingly, the dimension of the thermal print head A1 in the v direction can be reduced.

Moreover, according to this embodiment, the metal layer 6 is formed as covering the entire substrate insulating layer 18. Thus, steps such as patterning are not required during the formation process of the metal layer 6. This is suitable for better efficiency of the manufacturing process of the thermal print head A1. Moreover, the metal layer 6 is electrically connected to the common electrodes 32 and 33. The common electrodes 32 and 33 are parts electrically connected to all of the plurality of heat generating portions 41. Thus, the metal layer 6 cannot be forcibly partitioned into a plurality of parts insulated from one another.

Moreover, according to this embodiment, when the surface protection layer 59 includes an electrically conductive material, electrical connection to and conduction with a ground electrode (not shown) formed by exposing both ends in the x-direction from the insulative protection layer 5 can be accomplished. The surface protection layer 59 may easily contain static electricity since the surface protection layer 59 is a part that rubs against the printing medium. The surface protection layer 59 is able to appropriately transfer the charge carried to the ground electrode (not shown) of the wiring layer 3.

Moreover, according to this embodiment, the convex portion 13 is formed on the substrate 1. The plurality of heat generating portions 41 overlap with the convex portion 13 when viewed from the z direction. Accordingly, parts that contain the plurality of heat generating portions 41 can be pressed against the printing medium by a larger pressure. This is beneficial for fine printing. Moreover, the convex portion 13 has the top surface 130, the first inclined side surface 131 and the second inclined side surface 132. The top surface 130 is a planar surface parallel to the substrate main surface 11 of the substrate 1, and is preferably a portion for forming the plurality of heat generating portions 41. The configuration having the first inclined side surface 131 and the second inclined side surface 132 is suitable for forming the wiring layer 3 and the resistor layer 4 in a manner of crossing these surfaces.

Moreover, according to this embodiment, the substrate 1 includes Si as a single crystal semiconductor, and a (100) surface is selected as the substrate main surface 11. Thus, the convex portion 13 can be easily formed by performing anisotropic etching using KOH.

FIG. 15 to FIG. 21 show other embodiments of the disclosure. In these drawings, elements that are the same or similar to those in the embodiment above are assigned with the same denotations or numerals in the embodiment above.

Second Embodiment

Figure 15:
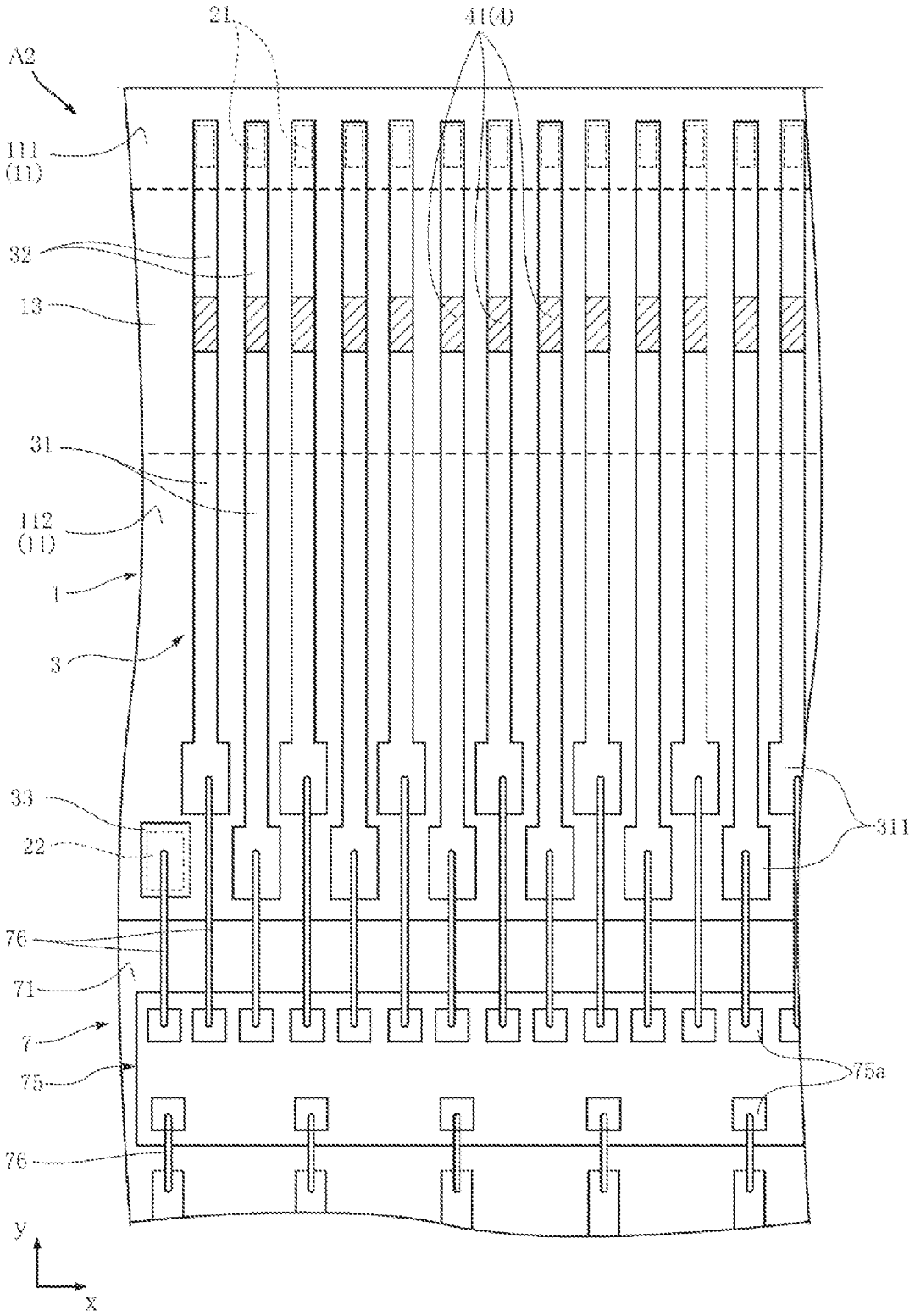
FIG. 15 is an enlarged top view of a main part of a thermal print head according to a second embodiment of the disclosure.

FIG. 15 is an enlarged top view of a main part of a thermal print head A2 according to a second embodiment of the disclosure, and corresponds to FIG. 2. In the thermal print head A2 of this embodiment, the configuration position of the common electrode first opening 21 is different from that in the embodiment above.

In this embodiment, the plurality of common electrode first openings 21 are disposed at positions overlapping with the first region 111 of the substrate main surface 11 instead of positions overlapping with the first inclined side surface 131. Moreover, the plurality of common electrodes 32 extend to the first region 111, and respectively overlap with the common electrode first openings 21.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Moreover, with the Ti-containing reduction layer 49 laminated between the insulating layer 2 and the resistor layer 4, the resistor layer first through conducting portion 421 and the resistor layer second through conducting portion 422 are in ohmic connection with the metal layer 6, hence more smoothly implementing electrical conduction.

Third Embodiment

Figure 16:
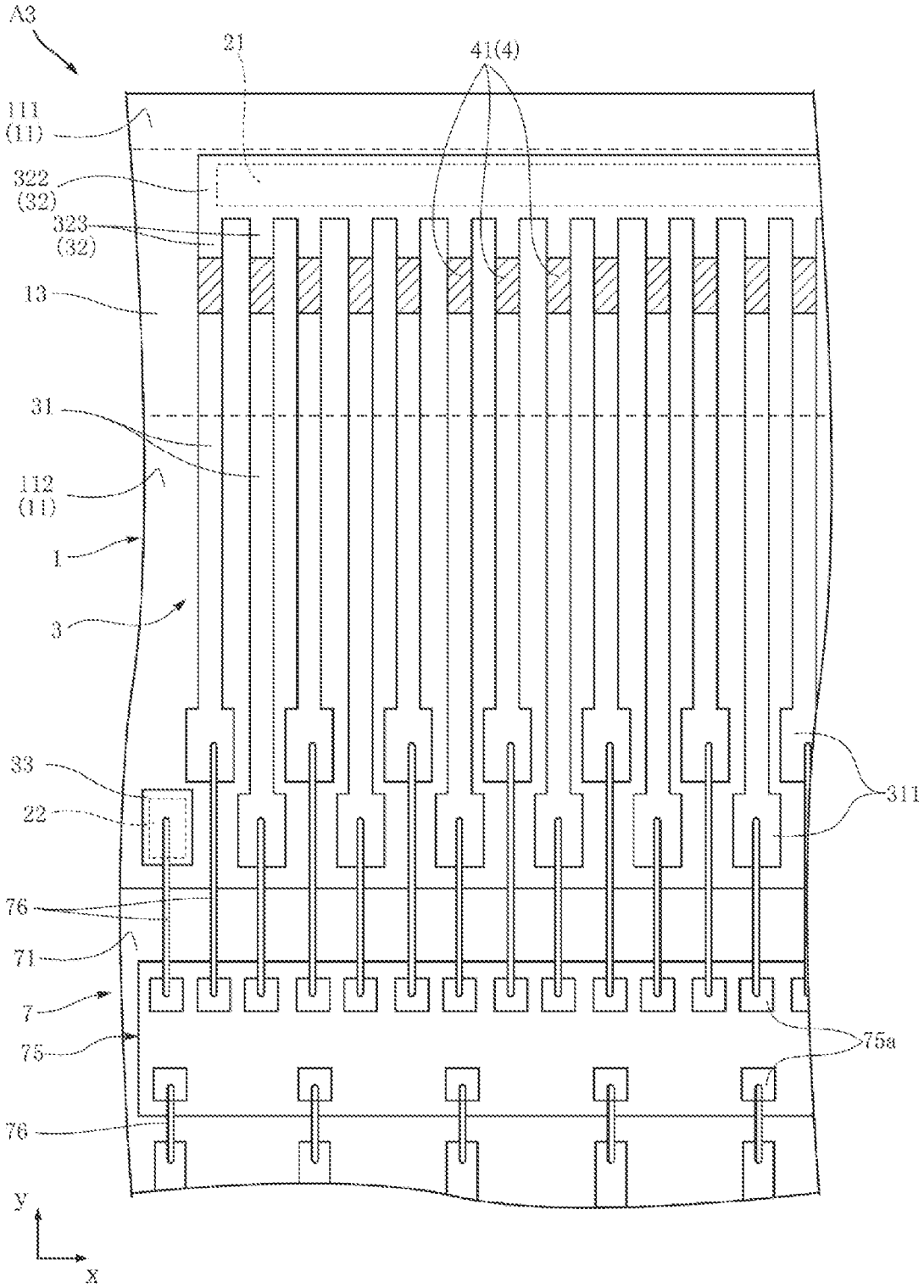
FIG. 16 is an enlarged top view of a main part of a thermal print head according to a third embodiment of the disclosure.

FIG. 16 is an enlarged top view of a main part of a thermal print head A3 according to a third embodiment of the disclosure, and corresponds to FIG. 2. In the thermal print head A3 of this embodiment, the shape of the common electrode 32 and the shape of the common electrode first opening 21 are different from those in the embodiments above.

In this embodiment, the thermal print head A3 includes one comb-shaped common electrode 32 in substitution for the plurality of common electrodes 33. The common electrode 32 includes: a connecting portion 322, extending in the x direction; and a plurality of strip portions 323, extending from the connecting portion 322 to the upstream side in the y direction. Front ends of the strip portions 323 are connected to the plurality of heat generating portions 41, respectively. In addition, the common electrode 32 is not limited to being one in quantity, and a plurality of comb-shaped common electrodes 32 may be arranged in the x direction. Moreover, in this embodiment, one common electrode first opening 21 is disposed in a manner of overlapping with the connecting portion 322 of the common electrode 32, and extends long in the x direction. In addition, the common electrode first opening 21 is not limited to being one in quantity, and a plurality of common electrode first openings 21 extending in the x direction may be arranged in the x direction.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Moreover, with the Ti-containing reduction layer 49 laminated between the insulating layer 2 and the resistor layer 4, the resistor layer first through conducting portion 421 and the resistor layer second through conducting portion 422 are in ohmic connection with the metal layer 6, hence more smoothly implementing electrical conduction. Accordingly, according to this embodiment, the common electrode first opening 21 extends long in the x direction, and thus the contact area between the reduction layer first through conducting portion 491 and the metal layer 6 becomes larger. Therefore, the contact resistance between the common electrode 32 and the metal layer 6 can be reduced.

Fourth Embodiment

Figure 17:
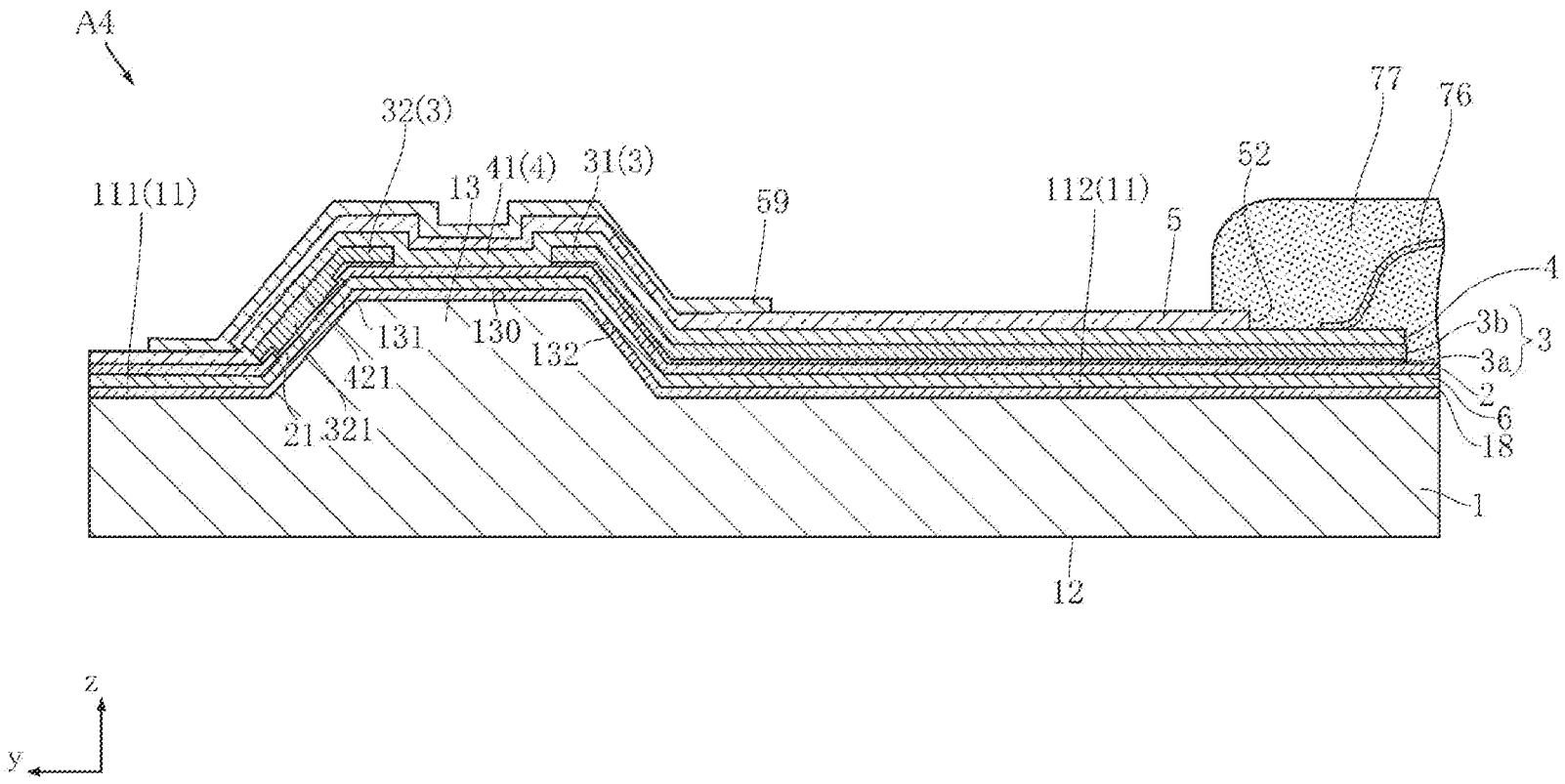
FIG. 17 is an enlarged sectional view of a main part of a thermal print head according to a fourth embodiment of the disclosure.

FIG. 17 is an enlarged sectional view of a main part of a thermal print head A4 according to a fourth embodiment of the disclosure, and corresponds to FIG. 4. In the thermal print head A4 of this embodiment, the laminated positions of the wiring layer 3 and the resistor layer 4 are different from those in the embodiments above.

In this embodiment, the wiring layer 3 is laminated on the insulating layer 2, and the resistor layer 4 is laminated on the wiring layer 3. Moreover, since the wiring layer 3 includes the Ti-containing first layer 3*a* on the side of the insulating layer 2, the wiring layer first through conducting portion 321 of the wiring layer 3 is in ohmic connection with the metal layer 6. Thus, the reduction layer 49 is not provided.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Accordingly, the cost for forming the reduction layer 49 can be eliminated since the reduction layer 49 is not provided.

Fifth Embodiment

Figure 18:
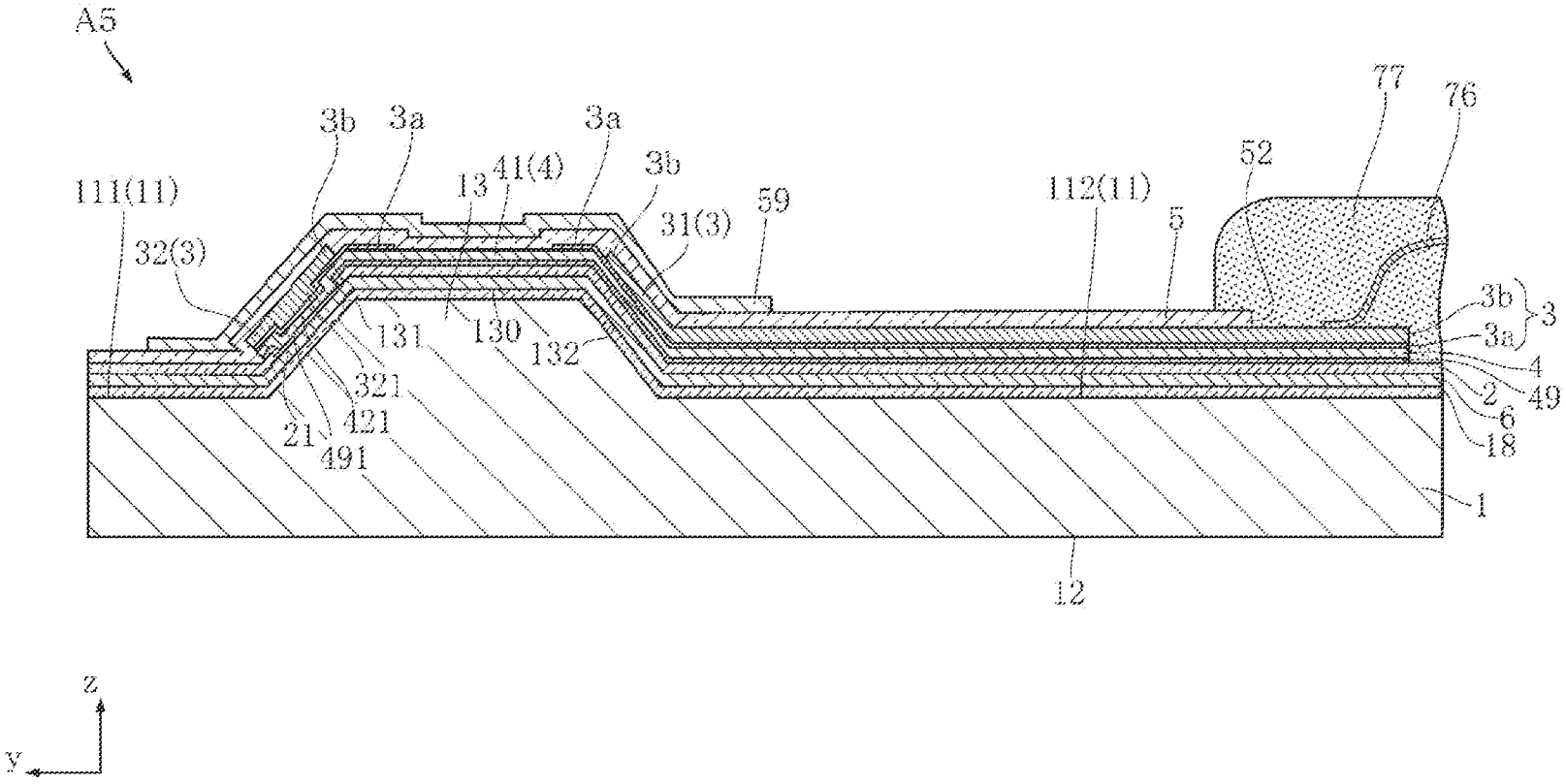
FIG. 18 is an enlarged sectional view of a main part of a thermal print head according to a fifth embodiment of the disclosure.

FIG. 18 is an enlarged sectional view of a main part of a thermal print head A5 according to a fifth embodiment of the disclosure, and corresponds to FIG. 4. In the thermal print head A5 of this embodiment, the shape of the second layer 3*b* of the wiring layer 3 is different from that in the embodiments above.

In this embodiment, the first layer 3*a* instead of the second layer 3*b* in the wiring layer 3 is formed in a region overlapping with the top surface 130 of the convex portion 13, near a border with the top surface 130 in the first inclined side surface 131 and near a border with the top surface 130 in the second inclined side surface 132. That is to say, the first layer 3*a* of the wiring layer 3 is exposed from the second layer 3*b*. The border between the first inclined side surface 131 and the top surface 130 and the border between the second inclined side surface 132 and the top surface 130 are curved in shape. The resistor layer 4 is mostly a layer having a relatively low resistance, and the resistor layer 4 is mostly a relatively thin layer. If the resistor layer 4 is exposed at such parts from the wiring layer 3, there are concerns for damage of the resistor layer 4 caused by concentrated current, concentrated temperature and concentrated stress. Thus, at these parts, it is ideal that the resistor layer 4 is covered by the wiring layer 3. On the other hand, since the thermal conductivity of Cu is relatively high, Cu unintentionally transmits heat generated by the heat generating portions 41 in the y direction. Thus, in this embodiment, near the border between the first inclined side surface 131 and the top surface 130 and near the border between the second inclined side surface 132 and the top surface 130, the resistor layer 4 is covered only by the first layer 3*a* containing Ti having a thermal conductivity lower than that of Cu, and the Cu-containing second layer 3*b* is not formed, so as to keep the second layer 3*b* away from the heat generating portions 41.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Moreover, with the Ti-containing reduction layer 49 laminated between the insulating layer 2 and the resistor layer 4, the resistor layer first through conducting portion 421 and the resistor layer second through conducting portion 422 are in ohmic connection with the metal layer 6, hence more smoothly implementing electrical conduction. Further, according to this embodiment, the first layer 3*a* instead of the second layer 3*b* in the wiring layer 3 is formed in a region overlapping with the top surface 130, near the border with the top surface 130 in the first inclined side surface 131 and near the border with the top surface 130 in the second inclined side surface 132. Accordingly, the resistor layer 4 near the borders may be protected, and the unintentional transmission of heat generated by the heat generating portions 41 in the y direction can be inhibited. This is beneficial for high-speed printing and clearing of the thermal print head A5.

Sixth Embodiment

Figure 19:
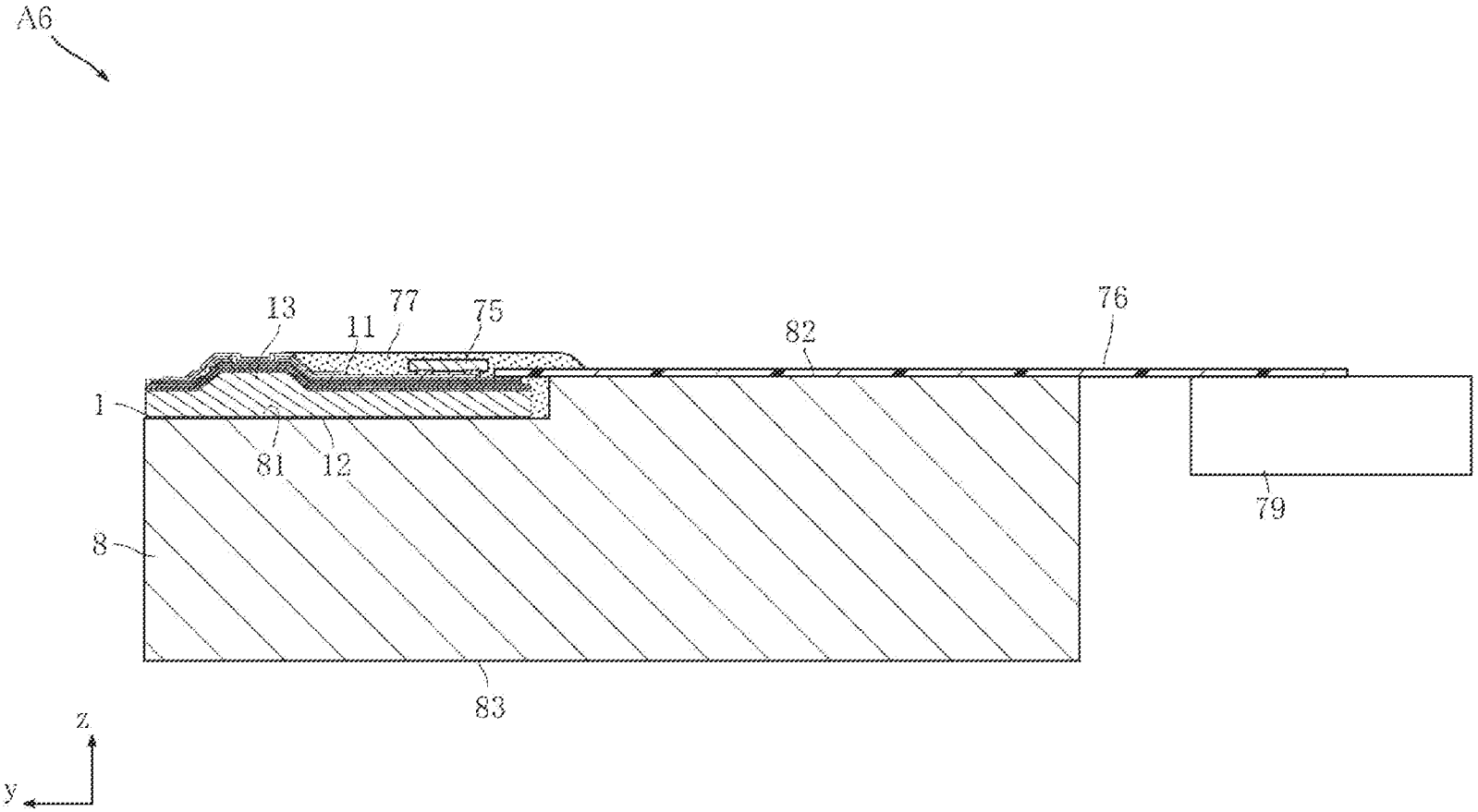
FIG. 19 is a sectional diagram of a thermal print head according to a sixth embodiment of the disclosure.
Figure 20:
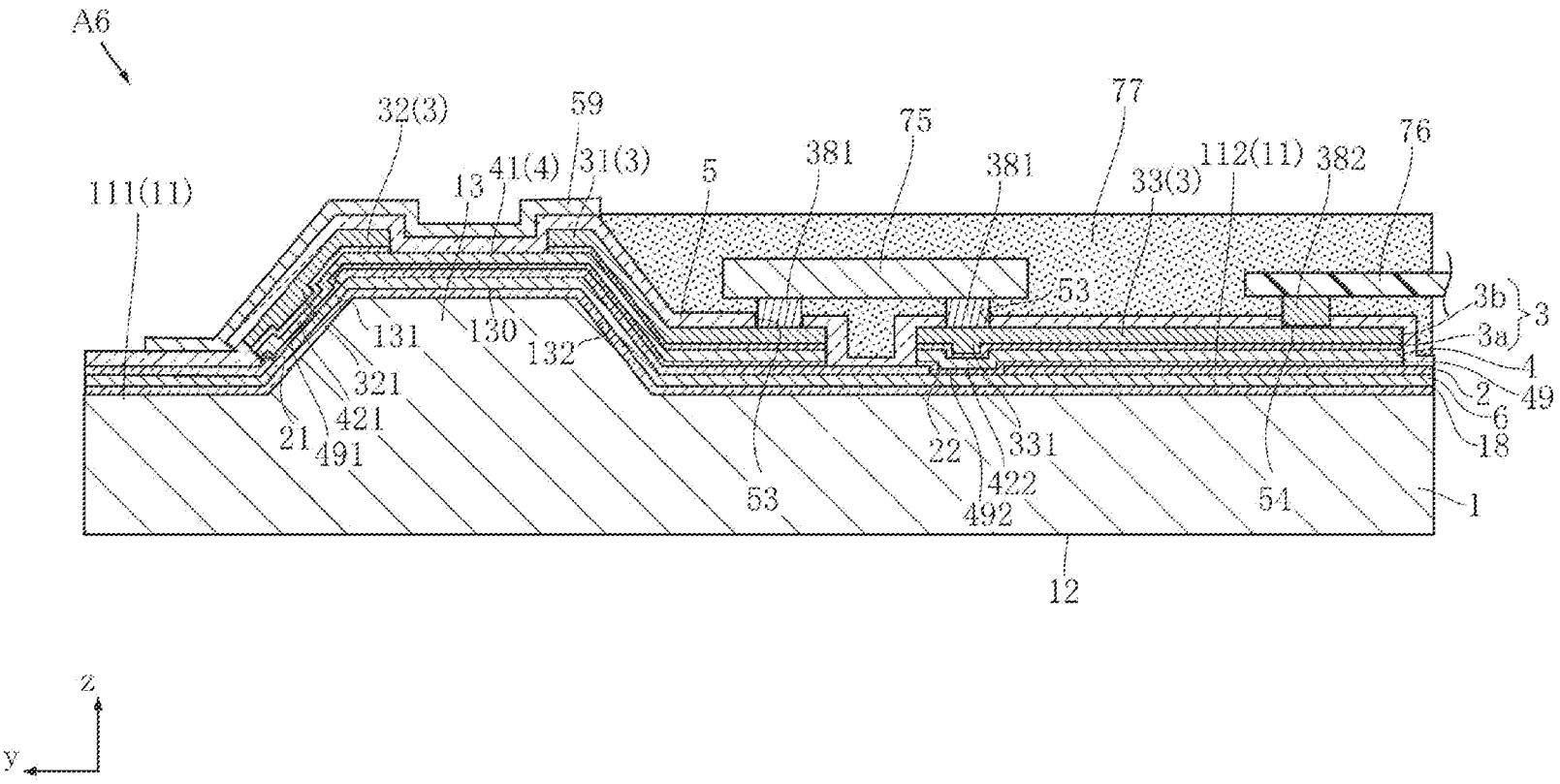
FIG. 20 is an enlarged sectional diagram of the thermal print head in FIG. 19.

FIG. 19 and FIG. 20 show a thermal print head A6 according to a sixth embodiment of the disclosure. FIG. 19 shows a sectional diagram of the thermal print head A6, and corresponds to FIG. 3. FIG. 20 is an enlarged sectional diagram of a main part of the thermal print head A6, and corresponds to FIG. 4. In the thermal print head A6 of this embodiment, the configuration positions and configuration method of the control elements 75 are different from those in the embodiments above.

In this embodiment, the control elements 75 are mounted on the substrate 1. In this embodiment, the insulative protection layer 5 has a plurality of control element openings 53. The plurality of control element openings 53 pass through the insulative protection layer 5. The plurality of control element openings 53 overlap with the second region 112 when viewed from the z direction, and respectively expose the individual electrodes 31, the common electrodes 33 or other electrodes. At each control element opening 53, a control element pad 381 connected to the individual electrode 31, the common electrode 33 or other electrode is formed. The control elements 75 are mounted in a manner of having a surface disposed with the plurality of electrodes 75*a* face the substrate main surface 11 of the substrate 1, wherein the electrodes 75*a* are respectively bonded to the control element pads 381 so as to be electrically connected to the individual electrodes 31, the common electrodes 33 or other electrodes.

Moreover, in this embodiment, the thermal print head A6 has a wiring component 78. The wiring component 78 is, for example, a printing wire substrate, has the connector 79 mounted thereon, and has a plurality of wires (not shown) for electrically connecting the wiring layer 3 to the connector 79. In this embodiment, the insulative protection layer 5 has a plurality of wiring component openings 54. The plurality of wiring component openings 54 pass through the insulative protection layer 5. The plurality of wiring component openings 54 overlap with the second region 112 when viewed from the z direction, and respectively expose the common electrodes 33 or other electrodes. At the wiring component opening 54, a wire component pad 382 connected to the common electrode 33 or other electrode is formed. The wires of the wiring component 78 are respectively bonded to the wire component pads 382 so as to be electrically connected to the common electrodes 33 or other electrodes. All of the plurality of control elements 75 and a part of the wiring component 78 are covered by the protective resin 77.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Moreover, with the Ti-containing reduction layer 49 laminated between the insulating layer 2 and the resistor layer 4, the resistor layer first through conducting portion 421 and the resistor layer second through conducting portion 422 are in ohmic connection with the metal layer 6, hence more smoothly implementing electrical conduction. Accordingly, according to this embodiment, the common electrode first opening 21 extends long in the x direction, and thus the contact area between the reduction layer first through conducting portion 491 and the metal layer 6 becomes larger. Therefore, the contact resistance between the common electrode 32 and the metal layer 6 can be reduced.

Seventh Embodiment

Figure 21:
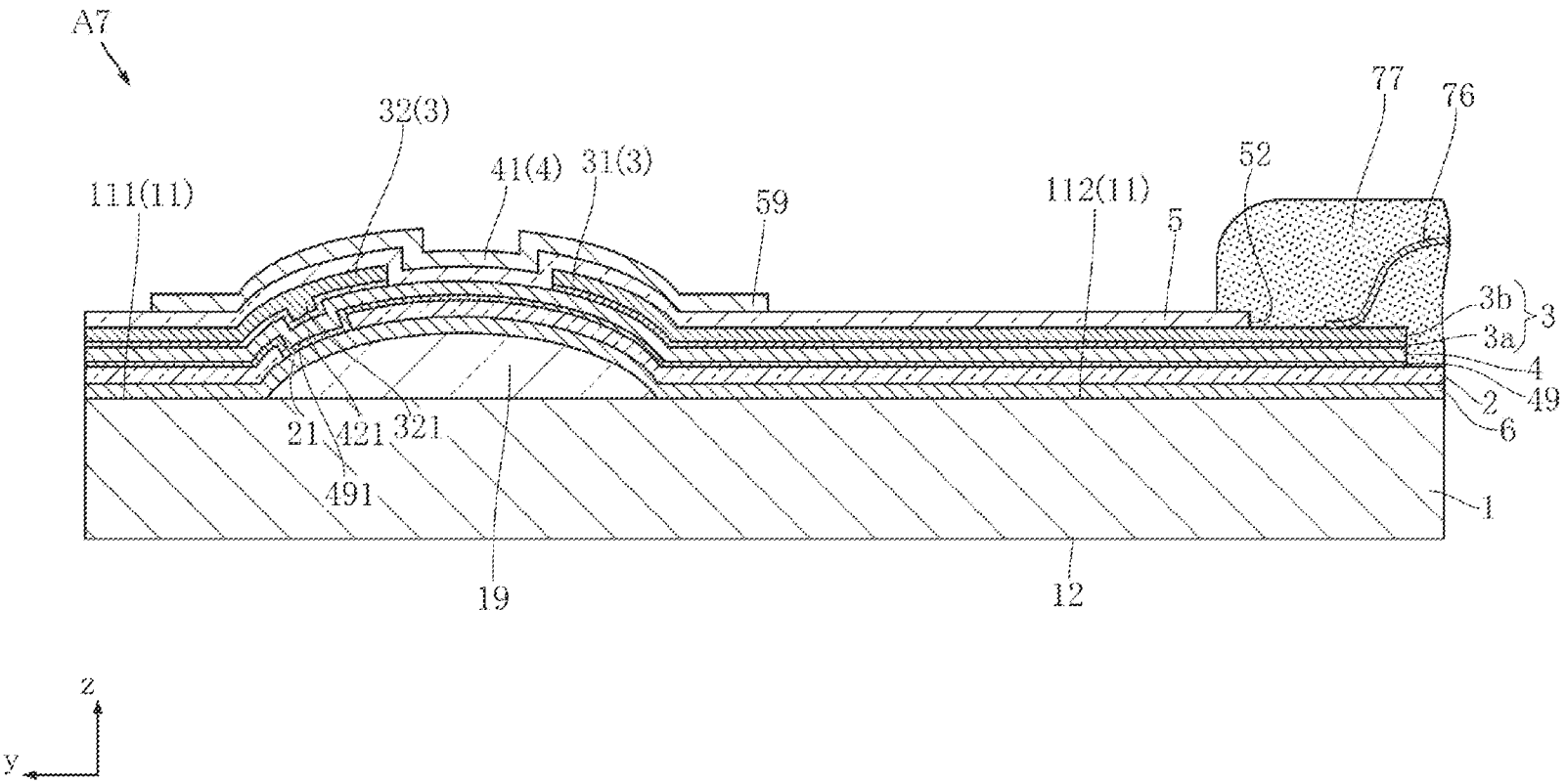
FIG. 21 is an enlarged sectional diagram of a main part of a thermal print head according to a seventh embodiment of the disclosure.

FIG. 21 is an enlarged sectional view of a main part of a thermal print head A7 according to a seventh embodiment of the disclosure, and corresponds to FIG. 4. In the thermal print head A7 of this embodiment, the material of the substrate 1 is different from that in the embodiments above.

In this embodiment, the substrate 1 is made of ceramics. The thermal print head A7 does not have the substrate insulating layer 18, but has a hot enamel 19 equivalent to the convex portion 13 in the first to sixth embodiments. The hot enamel 19 includes a glass material such as amorphous glass. The hot enamel 19 is formed by the following method: printing glass paste in the form of a thick film onto the substrate main surface 11 of the substrate 1, and baking the glass paste.

In this embodiment, the conduction path for electrically conducting the plurality of heat generating portions 41 includes the metal layer 6, and thus fine printing can also be achieved. Moreover, owing to α-Ta included in the metal layer 6, damage of the metal layer 6 caused by heat released from the heat generating portions 41 is inhibited, and heat release is inhibited without affecting energization. Moreover, with the Ti-containing reduction layer 49 laminated between the insulating layer 2 and the resistor layer 4, the resistor layer first through conducting portion 421 and the resistor layer second through conducting portion 422 are in ohmic connection with the metal layer 6, hence more smoothly implementing electrical conduction.

The thermal print head of the disclosure is not limited to the embodiments described above. Various design modifications may be made as desired to the specific structures of the components of the thermal print head of the disclosure.

[Note 1]

A thermal print head, comprising:

a substrate, having a substrate main surface and a substrate back surface facing opposite sides in a thickness direction;

a resistor layer, disposed on a side of the substrate main surface and including a plurality of heat generating portions arranged in a main scan direction to generate heat by energization;

a wiring layer, disposed on the side of the substrate main surface and including a conduction path for electrically conducting the plurality of heat generating portions;

a metal layer, interposed between the substrate and the wiring layer with the resistor layer; and an insulating layer, interposed between the metal layer and the wiring layer with the resistor layer;

wherein the conduction path includes the metal layer, and the metal layer includes tantalum (Ta).

[Note 2]

The thermal print head of note 1, wherein the Ta is α-Ta.

[Note 3]

The thermal print head of note 1 or 2, wherein the substrate is made of a single crystal semiconductor.

[Note 4]

The thermal print head of note 3, wherein the substrate includes silicon (Si).

[Note 5]

The thermal print head of note 3 or 4, wherein the substrate main surface is a (100) surface.

[Note 6]

The thermal print head of note 1 or 2, wherein the substrate is made of ceramics.

[Note 7]

The thermal print head of any one of notes 1 to 6, wherein the substrate includes a convex portion that protrudes in the thickness direction from the substrate main surface and extends long in the main scan direction, and wherein the plurality of heat generating portions overlap with the convex portion when viewed from the thickness direction.

[Note 8]

The thermal print head of any one of notes 1 to 7, further comprising a substrate insulating layer, interposed between the substrate and the metal layer and including an insulative property; wherein the substrate main surface is not exposed from the substrate insulating layer.

[Note 9]

The thermal print head of any one of notes 1 to 8, further comprising a reduction layer; wherein the resistor layer is disposed between the substrate and the wiring layer, and the reduction layer is interposed between the resistor layer and the metal layer.

[Note 10]

The thermal print head of note 9, wherein the reduction layer includes titanium (Ti).

[Note 11]

The thermal print head of any one of notes 1 to 10, wherein the wiring layer includes a first layer and a second layer. The first layer includes Ti and the second layer includes copper (Cu). The first layer is disposed closer to one side of the substrate than the second layer.

[Note 12]

The thermal print head of note 11, wherein the first layer is exposed from the second layer when viewed from the thickness direction.

[Note 13]

The thermal print head of any one of notes 1 to 12, wherein the wiring layer comprises:

a plurality of individual electrodes, respectively connected to the plurality of heat generating portions; and a common electrode, electrically connected to the plurality of heat generating portions, and including a portion disposed on a side opposite to the plurality of individual electrodes to sandwich the plurality of heat generating portions; and the common electrode is electrically connected to the metal layer.

[Note 14]

The thermal print head of note 13, wherein the insulating layer includes a first opening used for the common electrode and electrically connecting the common electrode to the metal layer.

[Note 15]

The thermal print head of note 14, wherein the insulating layer further includes a second opening used for the common electrode, the second opening being disposed on a side opposite to the first opening to sandwich the plurality of heat generating portions in a secondary scan direction and electrically connecting the common electrode to the metal layer.

[Note 16]

The thermal print head of any one of notes 1 to 15, further comprising:

a second substrate, disposed on an upstream side and in the secondary scan direction of the substrate; and a plurality of control elements, electrically connected to the wiring layer and individually electrically conducting the plurality of heat generating portions; wherein the plurality of control elements are mounted on the second substrate.

[Note 17]

The thermal print head of any one of notes 1 to 16, wherein the resistor layer is made of TaN.

What is claimed is:

1. A thermal print head, comprising a substrate, having a substrate main surface and a substrate back surface facing opposite sides in a thickness direction;

a resistor layer, disposed on a side of the substrate main surface and including a plurality of heat generating portions arranged in a main scan direction to generate heat by energization;

a wiring layer, disposed on the side of the substrate main surface and including a conduction path for electrically conducting the plurality of heat generating portions;

a metal layer, interposed between the substrate and the wiring layer with the resistor layer; and an insulating layer, interposed between the metal layer and the wiring layer with the resistor layer;

wherein the conduction path includes the metal layer, and the metal layer includes tantalum (Ta), further comprising a reduction layer; wherein the resistor layer is disposed between the substrate and the wiring layer, and the reduction layer is interposed between the resistor layer and the metal layer.

2. The thermal print head of claim 1, wherein the Ta is α-Ta.

3. The thermal print head of claim 1, wherein the substrate is made of a single crystal semiconductor.

4. The thermal print head of claim 3, wherein the substrate includes silicon (Si).

5. The thermal print head of claim 3, wherein the substrate main surface is a (100) surface.

6. The thermal print head of claim 1, wherein the substrate is made of ceramics.

7. The thermal print head of claim 1, wherein the substrate includes a convex portion that protrudes in the thickness direction from the substrate main surface and extends long in the main scan direction, and wherein the plurality of heat generating portions overlap with the convex portion when viewed from the thickness direction.

8. The thermal print head of claim 1, further comprising a substrate insulating layer, interposed between the substrate and the metal layer and including an insulative property; wherein the substrate main surface is not exposed from the substrate insulating layer.

9. The thermal print head of claim 1, wherein the reduction layer includes titanium (Ti).

10. The thermal print head of claim 1, wherein the wiring layer includes a first layer and a second layer, the first layer including Ti and the second layer including copper (Cu), the first layer disposed closer to one side of the substrate than the second layer.

11. The thermal print head of claim 10, wherein the first layer is exposed from the second layer in the thickness direction.

12. The thermal print head of claim 1, wherein the wiring layer comprises:

a plurality of individual electrodes, respectively connected to the plurality of heat generating portions; and a common electrode, electrically connected to the plurality of heat generating portions, and including a portion disposed on a side opposite to the plurality of individual electrodes to sandwich the plurality of heat generating portions, the common electrode being electrically connected to the metal layer.

13. The thermal print head of claim 12, wherein the insulating layer includes a first opening used for the common electrode and electrically connecting the common electrode to the metal layer.

14. The thermal print head of claim 13, wherein the insulating layer further includes a second opening used for the common electrode, the second opening being disposed on a side opposite to the first opening to sandwich the plurality of heat generating portions in a secondary scan direction and electrically connecting the common electrode to the metal layer.

15. The thermal print head of claim 1, further comprising:

a second substrate, disposed on an upstream side and in the secondary scan direction of the substrate; and a plurality of control elements, electrically connected to the wiring layer and individually electrically conducting the plurality of heat generating portions;

wherein the plurality of control elements are mounted on the second substrate.

16. The thermal print head of claim 1, wherein the resistor layer is made of TaN.

17. A thermal print head comprising:

a substrate, having a substrate main surface and a substrate back surface facing opposite sides in a thickness direction;

a resistor layer, disposed on a side of the substrate main surface and including a plurality of heat generating portions arranged in a main scan direction to generate heat by energization;

a wiring layer, disposed on the side of the substrate main surface and including a conduction path for electrically conducting the plurality of heat generating portions;

a metal layer, interposed between the substrate and the wiring layer with the resistor layer; and an insulating layer, interposed between the metal layer and the wiring layer with the resistor layer, wherein the conduction path includes the metal layer, and the metal layer includes tantalum (Ta), and the Ta is α-Ta.

18. The thermal print head of claim 17, wherein the metal layer has a thickness in a range from 0.5 micrometers to 5 micrometers.

* * * * *